US008320818B2

(12) United States Patent
Iwamoto

(10) Patent No.: US 8,320,818 B2
(45) Date of Patent: Nov. 27, 2012

(54) IMAGE PROCESSING APPARATUS AND IMAGE FORMING APPARATUS WHICH DETERMINES A PRINT REGION FOR A BOOK COMPOSED OF QUIRES

(75) Inventor: Takara Iwamoto, Tokyo (JP)

(73) Assignee: Oki Data Corporation, Tokyo (JP)

( * ) Notice: Subject to any disclaimer, the term of this patent is extended or adjusted under 35 U.S.C. 154(b) by 551 days.

(21) Appl. No.: 12/566,806

(22) Filed: Sep. 25, 2009

(65) Prior Publication Data

US 2010/0080641 A1 Apr. 1, 2010

(30) Foreign Application Priority Data

Sep. 30, 2008 (JP) ..... 2008-253572

(51) Int. Cl.
*G03G 15/00* (2006.01)
*B41F 13/54* (2006.01)

(52) U.S. Cl. ..... 399/408; 399/410; 270/1.01

(58) Field of Classification Search ..... 399/408, 399/410; 270/1.01, 37; 358/1.2
See application file for complete search history.

(56) References Cited

U.S. PATENT DOCUMENTS

| | | | | |
|---|---|---|---|---|
| 5,774,232 | A * | 6/1998 | Tabata et al. | 358/448 |
| 2002/0043755 | A1 * | 4/2002 | Machon et al. | 270/58.09 |
| 2006/0192986 | A1 * | 8/2006 | Suzuki | 358/1.13 |
| 2007/0065219 | A1 * | 3/2007 | Funatsu | 400/624 |
| 2007/0187883 | A1 * | 8/2007 | Tokashiki | 270/1.01 |

FOREIGN PATENT DOCUMENTS

| | | | |
|---|---|---|---|
| JP | 2003-305915 | A | 10/2003 |
| JP | 2004-066582 | A | 3/2004 |
| JP | 2006-244282 | A | 9/2006 |

OTHER PUBLICATIONS

Machine Translation of JP 2004-066582 to Mine published in Mar. 2004.*

Machine Translation of JP 2003-305915 to Kai published in Oct. 2003.*

Office Action issued Oct. 12, 2010 in Japanese Appln. Ser. No. 2008-253572.

* cited by examiner

*Primary Examiner* — Judy Nguyen
*Assistant Examiner* — Blake A Tankersley
(74) *Attorney, Agent, or Firm* — Panitch Schwarze Belisario & Nadel LLP

(57) ABSTRACT

An image processing apparatus and an image forming apparatus are supplied capable of adjusting binding margins per quire included in a quire book. In the image processing apparatus that has a setting section sets a quire page number of each quire; a size obtaining section obtains medium size information of the print mediums; an assigning and obtaining section assigns respective page numbers to each page of inputted image data and obtains an image page number; a page calculating section calculates an all page number of the quire book on the basis of the quire page number and the image page number; a determining section respectively determines a print region corresponding to the respective page number on the basis of the quire page number, the medium size information and the all page number; and a changing section respectively changes the image data to change image data within the determined print region.

20 Claims, 17 Drawing Sheets

IMAGE PROCESSING APPARATUS AND IMAGE FORMING APPARATUS WHICH DETERMINES A PRINT REGION FOR A BOOK COMPOSED OF QUIRES

FIELD OF THE INVENTION

The invention relates to an image processing apparatus that generates bookbinding print data, and relates to an image forming apparatus that forms images on the basis of the bookbinding print data, for saddle stitching and bookbinding by bundling a plurality of quires.

BACKGROUND OF THE INVENTION

An image processing apparatus that generates bookbinding print data by replacing a page order of manuscripts, and an image forming apparatus that performs spread print on respective print papers on the basis of the bookbinding print data, are known for saddle stitching and bookbinding quires made by folding manuscripts composed of a plurality of pages.

When quires are saddle stitched and bound through using such an image processing apparatus and an image forming apparatus, there is a problem that a gap of print positions occurs on folded parts between inside pages and outside pages of the quire in the case of folding and laying respective print papers.

In order to solve the problem stated above, in a patent document 1 mentioned below, such technology is disclosed capable of automatically adjusting margin amounts of respective pages so that the outer page has more margin amount as a binding margin that is set on a folded part.

Patent document 1: Japan patent publication No. 2003-305915.

However, in the former technology stated above, in the case of saddle stitching and bookbinding by bundling a plurality of quires into one, there is a problem that such image lack occurs on quires placed at the intermediate position, as pages look bad and the like.

Therefore, an image processing apparatus and an image forming apparatus are desirable that can adjust a binding margin for every quire.

SUMMARY OF THE INVENTION

It is, therefore, an objective of the invention to provide an image processing apparatus and an image forming apparatus that can solve the above problem.

A first aspect of the invention is to provide an image processing apparatus that has an image inputting section for inputting image data, saddle stitches respective quires that are made by folding print mediums, and processes image data for binding quires into a quire book that is composed of a plurality of pages, comprising: a setting section that sets a quire page number of each quire; a size obtaining section that obtains medium size information of the print mediums; an assigning and obtaining section that assigns respective page number to each page of the inputted image data, and obtains an image page number; a page calculating section that calculates an all page number of the quire book on the basis of the quire page number and the image page number; a determining section that respectively determines a print region corresponding to the respective page number on the basis of the quire page number, the medium size information and the all page number; and a changing section that respectively changes each page of the image data to change image data within the print region determined with respect to the corresponding page number.

A second aspect of the invention is to provide an image forming apparatus that has an image inputting section for inputting image data, saddle stitches respective quires that are made by folding print mediums, and processes image data for binding quires into a quire book that is composed of a plurality of pages, comprising: a setting section that sets a quire page number of each quire; a size obtaining section that obtains medium size information of the print medium; an assigning and obtaining section that assigns respective page number to each page of the inputted image data, and obtains an image page number; a page calculating section that calculates an all page number of the quire book on the basis of the quire page number and the image page number; a determining section that respectively determines a print region corresponding to the respective page number on the basis of the quire page number, the medium size information and the all page number; a changing section that respectively changes each page of the image data to change image data within the print region determined with respect to the corresponding page number; and an image forming section that forms images onto the print mediums by using developer on the basis of the respective change image data that was changed.

EFFECT OF THE PRESENT INVENTION

According to the image processing apparatus and the image forming apparatus of the present invention, because print regions of respective pages are determined on the basis of the quire page number and the all page number, even when a plurality of quires are saddle stitched and bound into a quire book, binding margins are suitably adjusted, and the occurrence of bad conditions such as image lack can be prevented. Therefore, it is possible to bind quires into a nice-looking quire book with nice-looking.

The above and other objectives and features of the present invention will become apparent from the following detailed description and the appended claims with reference to the accompanying drawings.

DETAILED DESCRIPTION OF THE PREFERRED EMBODIMENTS

Embodiments of the invention will be described in detail hereinafter with reference to the drawings.

Hereinbelow, it is to explain enforcement form of the present invention in detail by using figures. Here, it is to explain an example in the case to apply the present invention to a digital compound apparatus.

<Embodiment 1>

Figure 2:
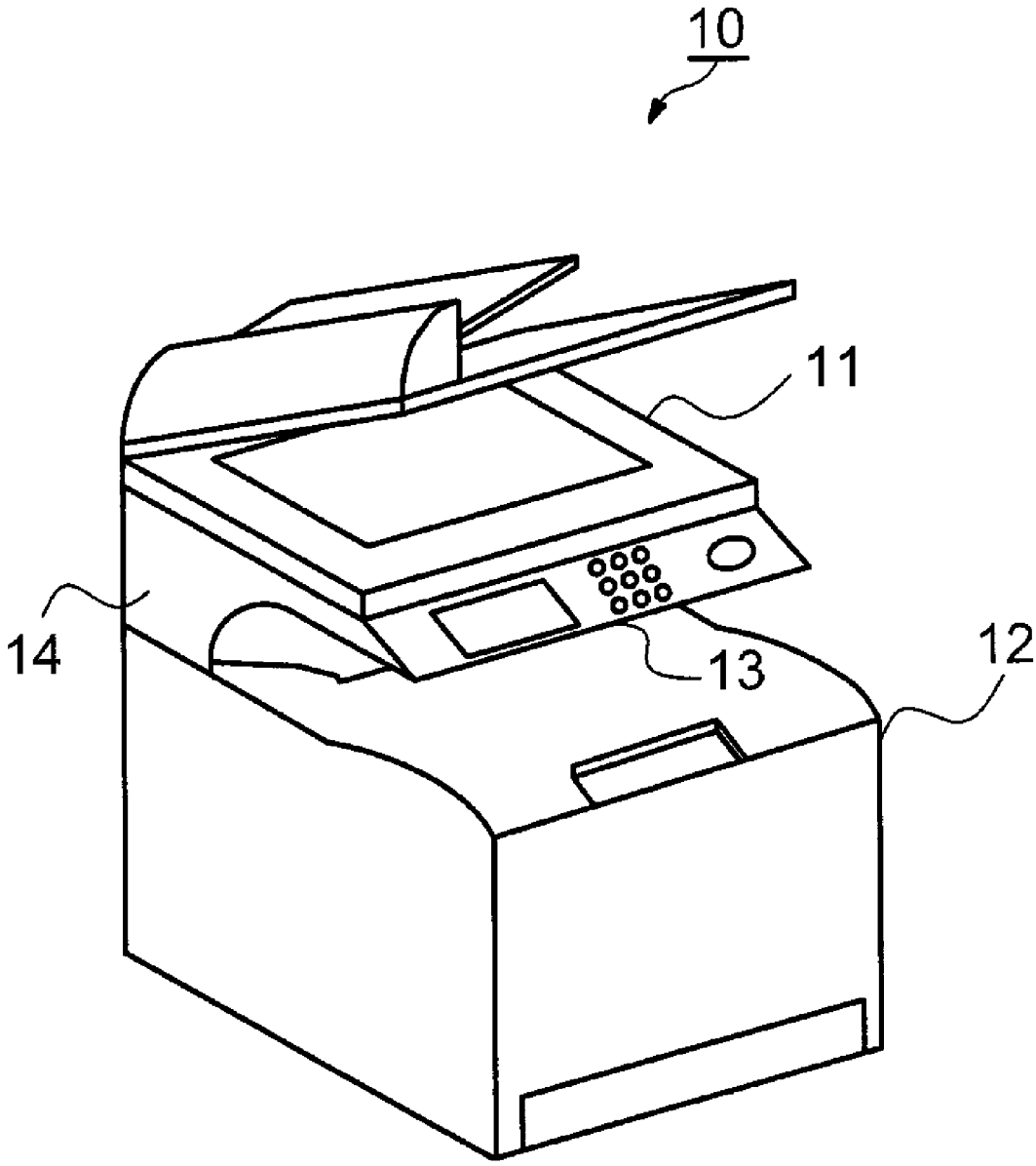
FIG. 2 is an outline structure diagram of a digital compound apparatus of the present invention.
Figure 3:
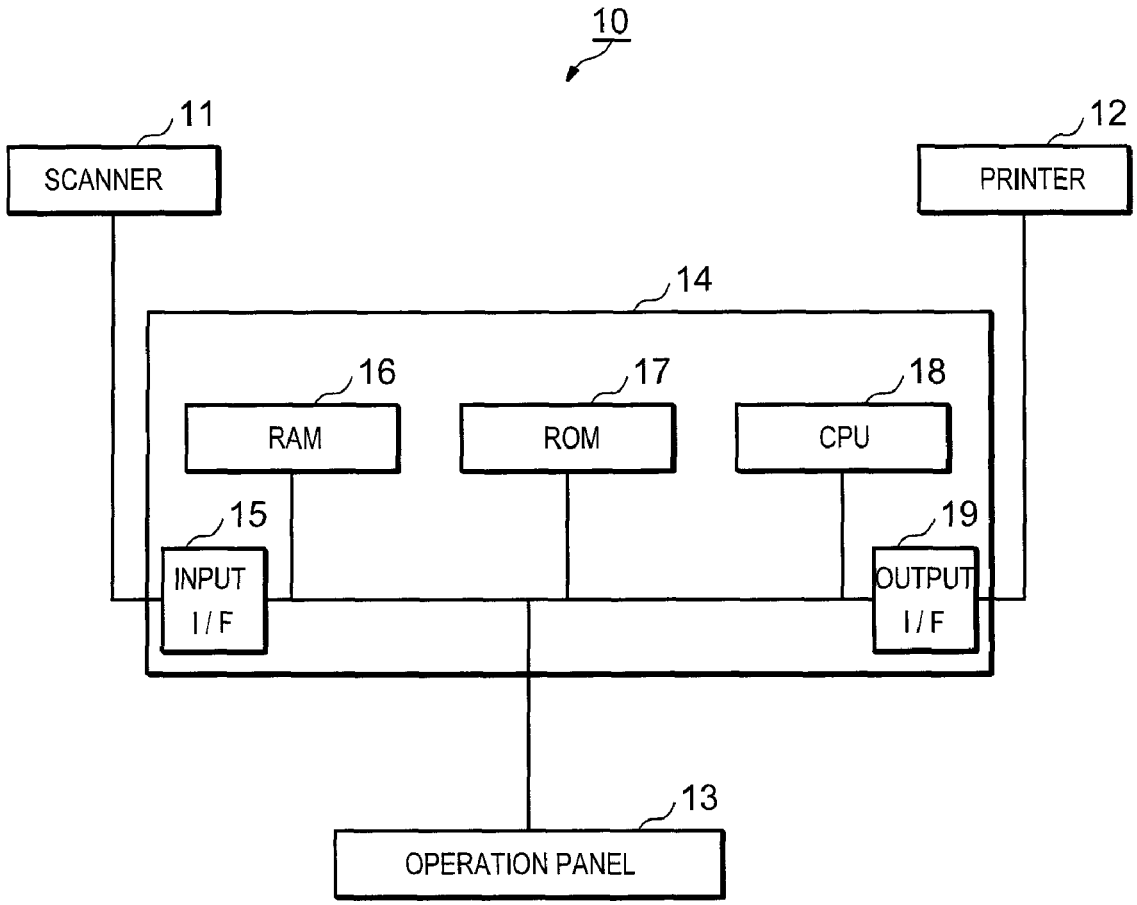
FIG. 3 is a block diagram concretely showing a structure of a digital compound apparatus of the present invention.

FIG. 2 is an outline structure diagram of a digital compound apparatus of the present invention; and FIG. 3 is a block diagram concretely showing a structure of a digital compound apparatus of the present invention.

A digital compound apparatus 10 of the present embodiment, as an image forming apparatus, for binding quires into a quire book that is saddle stitched by folding plural quires, generates bookbinding print data, executes image forming process on the basis of the bookbinding print data, and outputs book manuscripts.

The digital compound apparatus 10, as shown by FIG. 2 and FIG. 3, comprises a scanner 11 as an image inputting section, a printer 12 as an image forming section, an operation panel 13 as an operation inputting section and an image processing section 14 as an image processing apparatus.

The scanner 11 comprises a manuscript loading table for loading a read manuscript, an automatic manuscript conveying device capable of conveying a plurality of sheets of read manuscripts in order and an image reading section, reads images of read manuscripts, obtains image data that is digital data, and outputs the image data to the image processing section 14.

In the image reading section of the present embodiment, source of light that irradiates light onto a read object surface of a read manuscript that is loaded on the manuscript loading table or a read manuscript that is conveyed through the automatic manuscript conveying device, light receiving elements that obtain image signals by receiving reflected light from the read manuscript, and a signal processing section that obtains image data that is digital data by performing signal process such as A/D conversion and the like to image signals that are obtained through light receiving elements, are established.

The image processing section 14, as an image processing apparatus, as shown by FIG. 3, includes an input I/F 15, a RAM 16, a ROM 17, a CPU 18 and an output I/F 19 that are connected mutually through bus.

The input I/F 15 is an interface section in which image data obtained through the scanner 11 is inputted, and forwards the image data to the RAM 16.

The RAM (Random Access Memory) 16 is a volatile memory, and has a function of storing data temporarily as a temporary storing section. The RAM 16 stores, for example, image data obtained through the scanner 11. Further, the RAM 16 is used as a work region during the execution process of respective control programs in CPU 18.

The ROM (Read Only Memory) 17 is a nonvolatile memory only for reading. In the ROM 17, control programs executed through the CPU 18, fixed data and the like are previously stored.

The CPU (Central Processing Unit) 18 is a central processing unit that performs generalization control of the digital compound apparatus 10, and executes control programs stored in the ROM 17 by regarding the RAM 16 as a work region.

The output I/F 19, as an outputting section, outputs image data stored in the RAM 16 to the printer 12.

The printer 12, as an image forming section, receives image data from the image processing section 14, forms a toner image as a developer image on the basis of the image data, and transfers and fixes the toner image into the paper as a print medium.

The operation panel 13, as an operation inputting section, has numeric keypad, a select key, a read start button and the like together with liquid crystal display and touch panel, and has a function of displaying all kinds of information to an operator and a function of inputting all kinds of information selected by the operator. The operator presses, for example, the read start button to select read start of an image. Further, the operator operates the operation panel 13 to select all kinds of setting information such as a quire page number, a paper size value and the like stated below.

Next, it is to explain about a control system of the digital compound apparatus 10 of the present embodiment.

Figure 1:
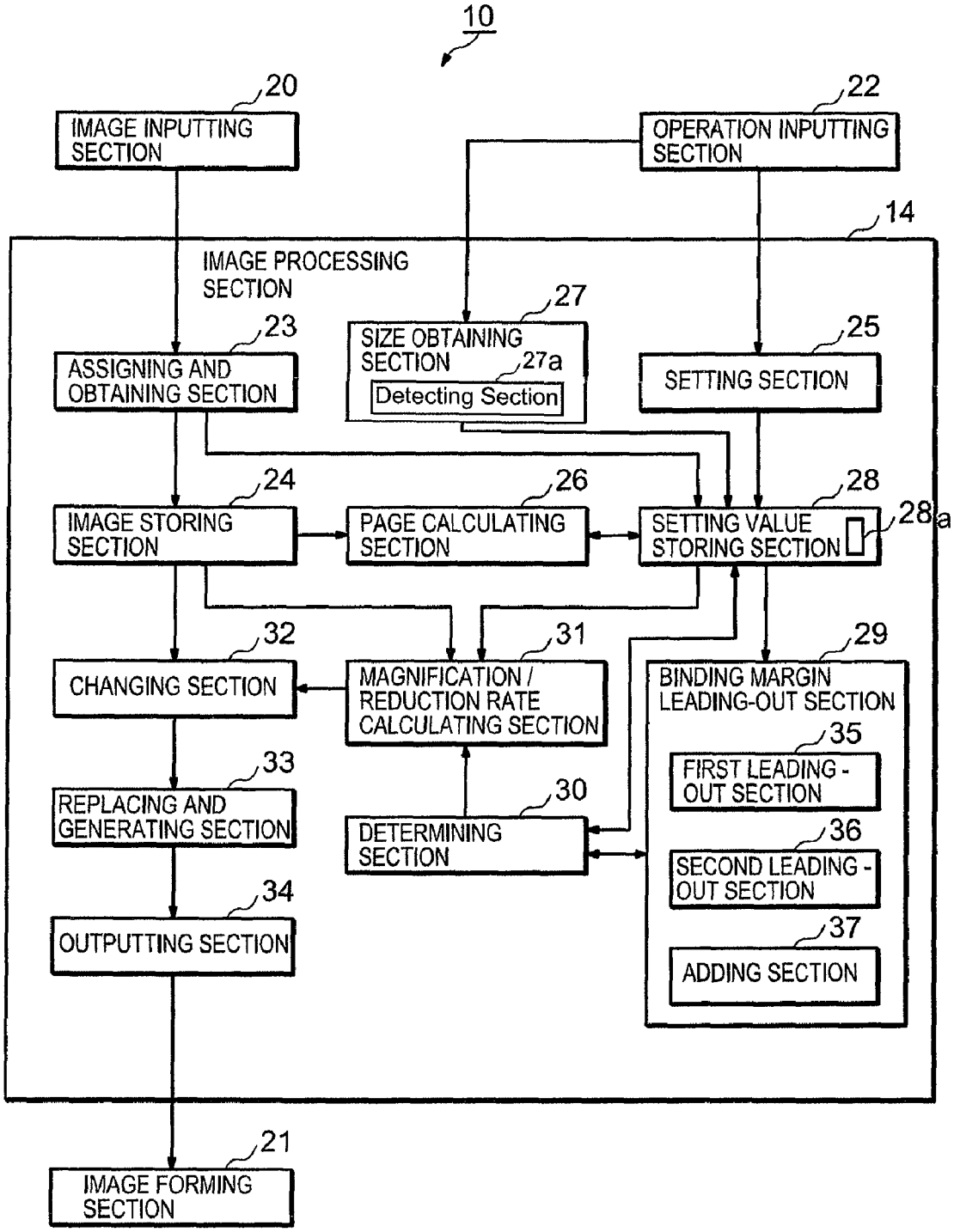
FIG. 1 is a block diagram showing a function structure of a digital compound apparatus in embodiment 1 of the present invention.

FIG. 1 is a block diagram showing a function structure of a digital compound apparatus in embodiment 1 of the present invention.

The digital compound apparatus 10, as shown by FIG. 1, comprises an image inputting section 20, an image forming section 21, an operation inputting section 22 and an image processing section 14.

The image inputting section 20 is composed of the scanner 11, reads respective images from a plurality of sheets of read manuscripts for saddle stitching and bookbinding, obtains respective image data, and outputs them to the image processing section 14. The image inputting section 20 of the present embodiment obtains image data that is composed of RGB bit map data.

The image forming section 21 is composed of the printer 12, performs a tone correction for bookbinding print data inputted from the image processing section 14, and forms an image on respective paper as a print medium by using toner of respective colors as developer. In the digital compound apparatus 10 of the present embodiment, the image forming section 21 forms images of respective pages on the right and left of both sides of respective papers to output book manuscripts for a quire book.

The operation inputting section 22 is composed of the operation panel 13, and inputs all kinds of information on the basis of operation of the operator.

For example, the operation inputting section 22 inputs a page number per quire, that is, a quire page number "P". The image forming section 21 of the present invention, as stated above, forms images of four page parts on respective paper. Therefore, the operation inputting section 22 inputs the quire page number P=4i (i=1, 2, . . . ).

Further, the operation inputting section 22 inputs a paper size value as medium size information representing a paper size of papers using for bookbinding print.

Figure 4:
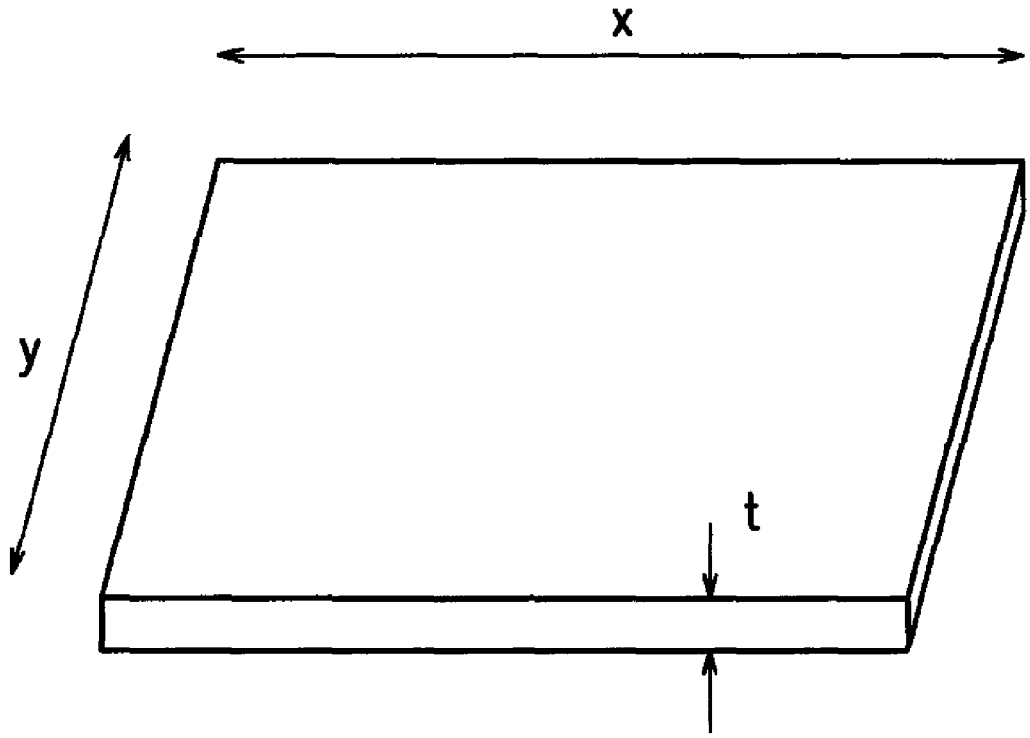
FIG. 4 is a diagram showing a paper size.

FIG. 4 is a diagram showing a paper size.

The operation inputting section 22 inputs a paper long side value "x" representing a long side size of papers, a paper short side value "y" representing a short side size of papers and a paper thickness value "t" representing a paper thickness size.

The image processing section 14, as shown by FIG. 1, comprises an assigning and obtaining section 23, an image storing section 24, a setting section 25, a page calculating section 26, a size obtaining section 27, a setting value storing section 28, a binding margin leading-out section 29, a determining section 30, a magnification/reduction rate calculating section 31, a changing section 32, a replacing and generating section 33 and an outputting section 34.

The assigning and obtaining section 23 assigns page numbers n (n=1, 2, . . . ) to respective image data inputted from the image inputting section 20 in an input order, makes respective image data correspond to the page numbers n, and makes the image storing section 24 store the image data. Further, the assigning and obtaining section 23 obtains an all page number of image data, that is, an image page number "M". Furthermore, the assigning and obtaining section 23 regards a page size of respective image data as a page size value, obtains a page long side value "X" representing a long side size of a image and a page short side value "Y" representing a short side size of the image, and makes the image storing section 24 store them.

The image storing section 24 is composed of the RAM 16, and stores respective image data of read manuscripts to correspond to page numbers "n". The image storing section 24 furthermore stores page size values composed of the page long side value "X" and the page short side value "Y" to correspond to respective page numbers "n".

The setting section 25 sets the quire page number "P" inputted from the operation inputting section 22 into the setting value storing section 28.

The page calculating section 26 calculates a quire number "K" that is a set number of a quire page number "P" unit contained in a quire book according to a formula K=ceiling (M/P) on the basis of the quire page number "P" that is set into the setting value storing section 28 and the image page number "M" that is obtained through the assigning and obtaining section 23. Here, the function ceiling(X) is a ceiling function defined as the smallest integer that becomes more than "X" with respect to a real number "X".

Further, the page calculating section 26 calculates an all page number "N" of a quire book according to a formula N=K×P.

The size obtaining section 27 obtains the paper size value inputted from the operation inputting section 22, and makes the setting value storing section 28 store it. The size obtaining section 27 obtains the paper long side value "x", the paper short side value "y" and the paper thickness value "t" that are regarded as the paper size value, and set them into the setting value storing section 28. Moreover, the size obtaining section 27 has a detecting section 27*a* which can also detect and obtain the paper size values from papers used for bookbinding print. At this time, the size obtaining section 27 is composed of, for example, a sensor established in a loading section in which paper is loaded.

The setting value storing section 28 is composed of the RAM 16, and stores the quire page number "P" that is set by the setting section 25, the quire number "K" and the all page number "N" that are calculated through the page calculating section 26, together with the paper long side value "x", the paper short side value "y" and the paper thickness value "t" that are obtained through the size obtaining section 27 and the like.

The binding margin leading-out section 29, as shown by FIG. 1, has a first leading-out section 35, a second leading-out section 36 and an adding section 37, and leads out binding margin values L(n) corresponding to respective page numbers "n" as a leading-out section. Here, the binding margin value L(n) represents length of a margin region that is set from a folded position of a page corresponding to the page number "n" to a print region of the page.

The first leading-out section 35 leads out length from the folded position to a binding position of the page corresponding to the page number "n" as a first binding margin value $L_1(n)$. In the present embodiment, the printed book manuscripts, after folded at a centerline that is the center of the long side direction of respective paper and laid per quire, are bound into a quire book through staples at fixed binding positions. The first leading-out section 35 leads out length of the margin region that is set from the folded position to the binding position of the page corresponding to respective page number "n" as the first binding margin value $L_1(n)$.

The second leading-out section 36 leads out length of a margin region that is set from the binding position of the page corresponding to the page number "n" to the print region of the page as a second binding margin value $L_2(n)$.

The adding section 37 adds the first binding margin value $L_1(n)$ and the second binding margin value $L_2(n)$, and leads out a binding margin value $L(n)=L_1(n)+L_2(n)$.

The determining section 30 determines a print region A(n) per page on the basis of the paper long side value "x" and the paper short side value "y" that are set by the setting value storing section 28, along with the binding margin value L(n) that is led out by the binding margin leading-out section 29.

The magnification/reduction rate calculating section 31 calculates a magnification/reduction rate R(n) of image data on the basis of a region long side value $A_x(n)$ and a region short side value $A_y(n)$ of the print region A(n) corresponding to the page number "n", together with the page long side value "X" and the page short side value "Y" of corresponding image data. The magnification/reduction rate calculating section 31 calculates a long side magnification/reduction rate $R_x(n)=A_x(n)/X$, and a short side magnification/reduction rate $R_y(n)=A_y(n)/Y$, compares them, and regards the magnification/reduction rate R corresponding to the page number "n" as the smaller one.

The changing section 32 performs magnification/reduction of image data on the basis of the calculated magnification/reduction rate R(n), and generates change image data.

The replacing and generating section 33 replaces a page order of the change image data corresponding to the respective page numbers "n" with a print order, and generates bookbinding print data.

The outputting section 34 is composed of the output I/F 19 (FIG. 3), and outputs the bookbinding print data generated by the replacing and generating section 33 to the image forming section 21.

Further, the digital compound apparatus 10 provides a controlling section (not shown) for controlling the respective sections stated above.

Next, it is to explain saddle stitching and bookbinding.

FIG. 5 is a diagram showing saddle stitching and bookbinding.

Figure 5A:
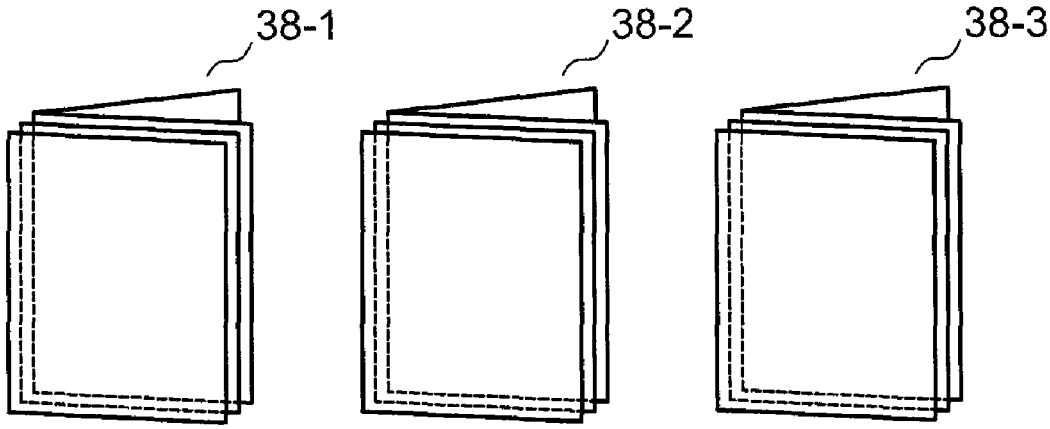
FIG. 5 is a diagram showing saddle stitching and bookbinding.
Figure 5B:
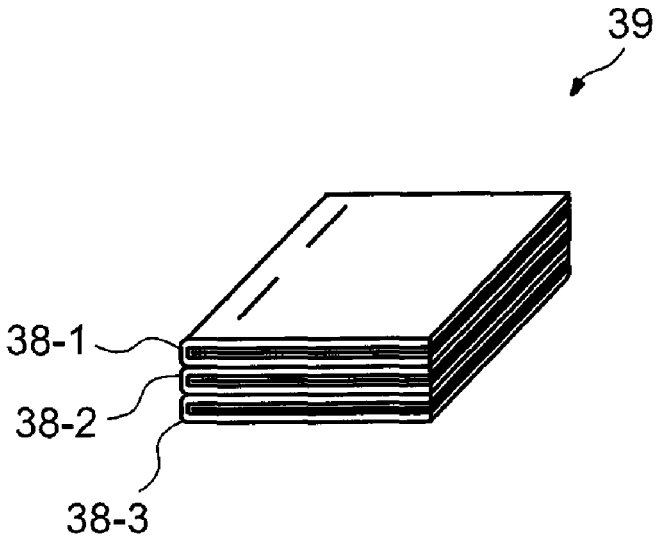

In the digital compound apparatus 10 of the present embodiment, for example, when a quire page number P=12 is set, three sheets of book manuscripts in which images of four page parts are formed on the right and left of both sides of each paper, are folded, and respective quires are made, as shown by FIG. 5A. A quire book 39 made by saddle stitching and binding three quires 38-1, 38-2 and 38-3 is shown by FIG. 5B. The respective quires 38-1, 38-2 and 38-3 are bundled through the staple at the fixed binding position, and are bound into a quire book 39.

Figure 6:
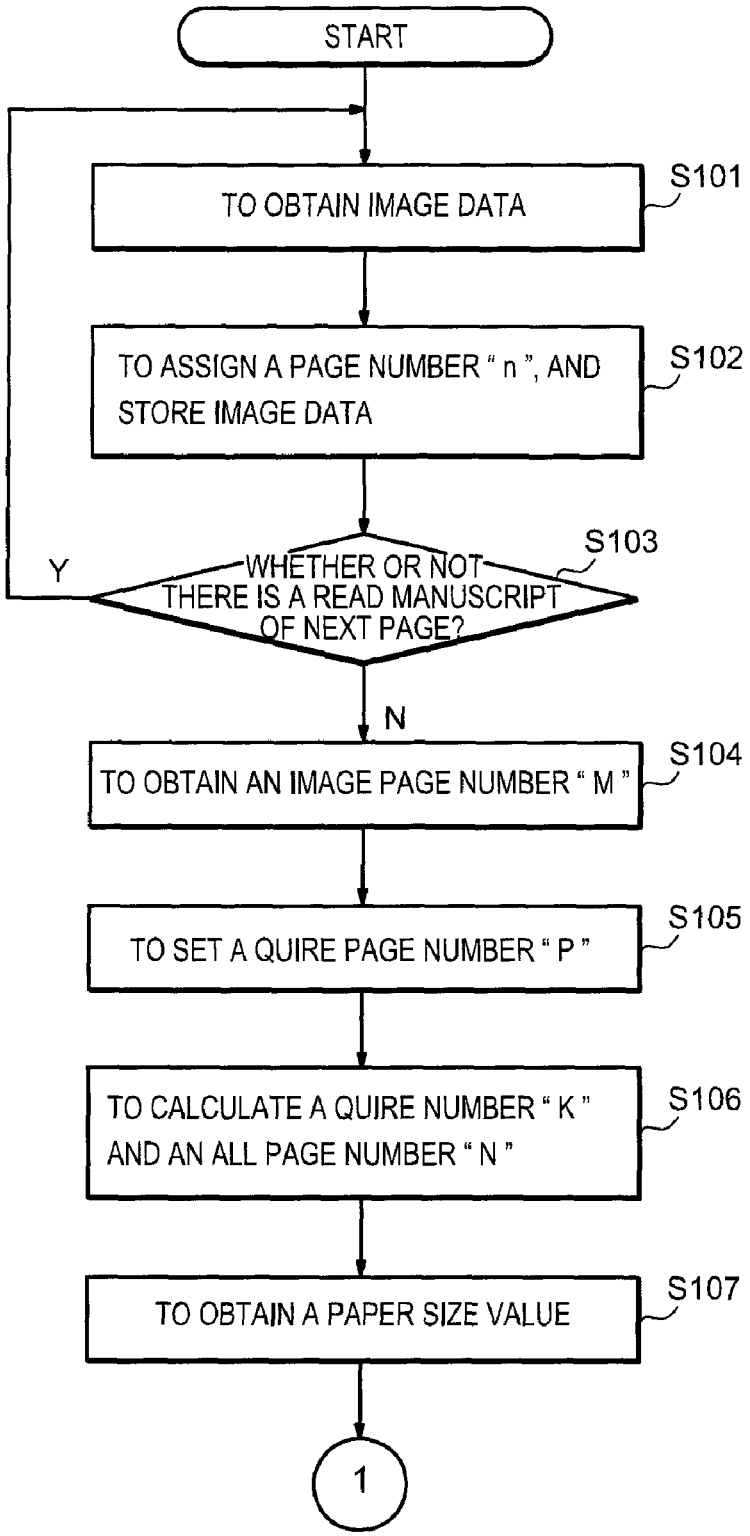
FIG. 6 is a first flow chart for explaining a book manuscript generating operation of a digital compound apparatus in embodiment 1 of the present invention.
Figure 7:
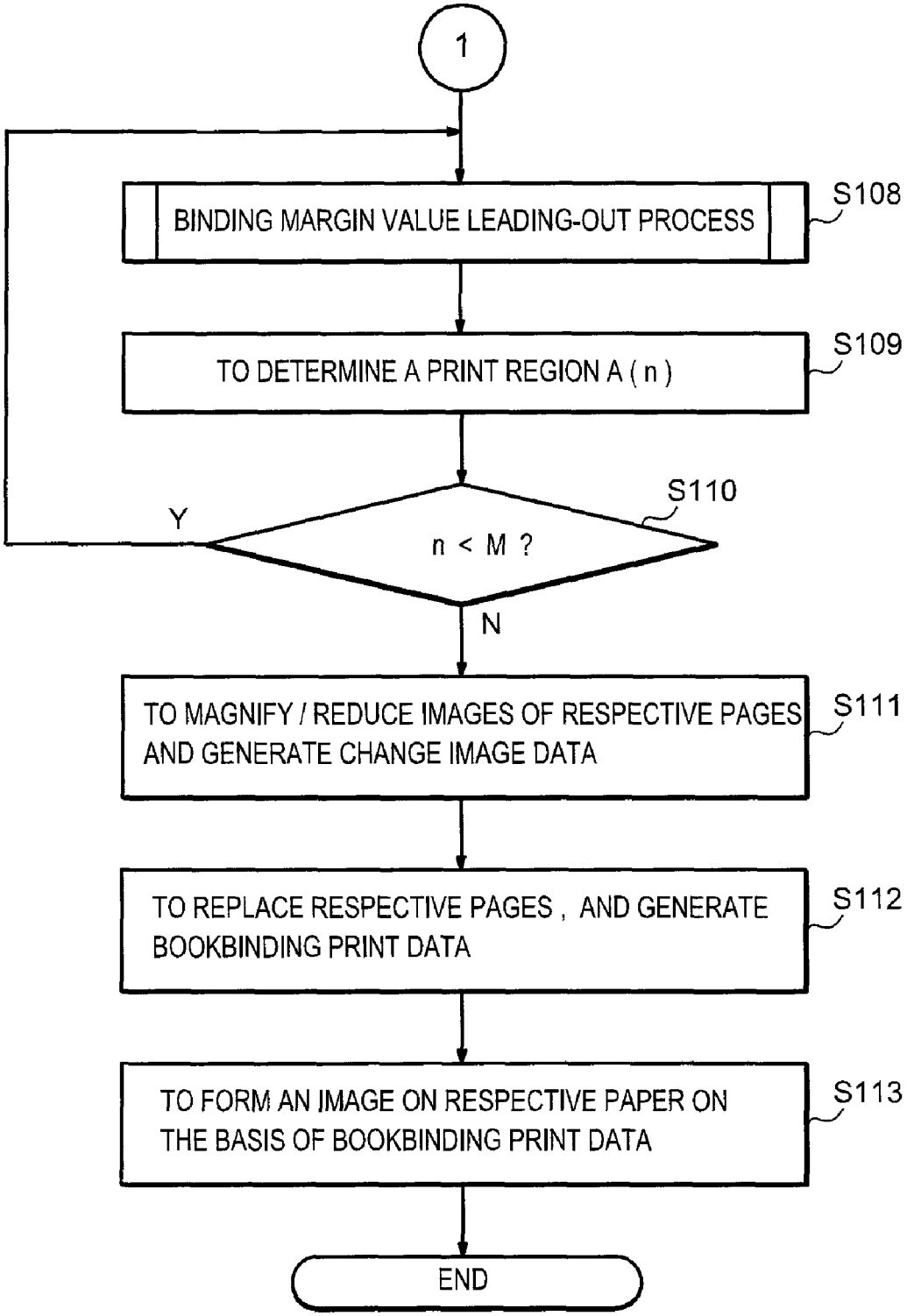
FIG. 7 is a second flow chart for explaining a book manuscript generating operation of a digital compound apparatus in embodiment 1 of the present invention.

Here, it is to explain about a flow of generating and outputting book manuscripts for a quire book by reading a plurality of sheets of read manuscripts with a flow chart shown in FIG. 6 and FIG. 7.

FIG. 6 is a first flow chart for explaining a book manuscript generating operation of a digital compound apparatus in embodiment 1 of the present invention; and FIG. 7 is a second flow chart for explaining a book manuscript generating operation of a digital compound apparatus in embodiment 1 of the present invention.

Hereinbelow, it is to explain an example when 33 sheets of read manuscripts that have the page long side value "X" and the page short side value "Y" are read, the quire page number P=12, the paper long side value "x", the paper short side value "y" and the paper thickness value "t" are set. At this time, respective quires that composes a quire book, are made by folding book manuscripts in which images are formed on three sheets of papers.

In the digital compound apparatus 10, after the read start button of the operation panel 13 is pressed, the operation inputting section 22 inputs a read start request of read manuscripts. On the basis of the read start request, a controlling section (not shown) instructs the image inputting section 20 to start reading the read manuscripts.

Then, the image inputting section 20, firstly, reads an image of the first sheet of the read manuscripts, and obtains image data and inputs it (Step S101).

After the image data is inputted into the image processing section 14 from the image inputting section 20, the assigning and obtaining section 23 assigns a page number n=1 to the inputted image data, and makes the image storing section 24 store the image data together with the page number n=1 (Step S102). In the image storing section 24, the image data of the first sheet of the read manuscripts is stored that corresponds to the page number n=1.

Further, the assigning and obtaining section 23 obtains a page size of the image data. The assigning and obtaining section 23 obtains a page long side value "X" and a page short side value "Y", makes the image storing section 24 store them.

Continuously, the image inputting section 20 judges whether or not there is a read manuscript of the next page part (Step S103). When there is a read manuscript of the next page part (Step S103), the image inputting section 20 reads an image of the read manuscript, and obtains image data and inputs it (Step S101).

Then, the assigning and obtaining section 23 assigns a page number "n" to the image data, and makes the image storing section 24 store it.

After image data of the read manuscript corresponding to the page number n=33 is obtained (Step S101), and is stored in the image storing section 24 (Step S102), the image inputting section 20 judges that there is no read manuscript of the next page part (Step S103), and informs the image processing section 14 and the controlling section of read completion. The assigning and obtaining section 23 obtains an image page number M=33, and makes the setting value storing section 28 store it (Step S104).

After the read completion is informed from the image inputting section 20, the controlling section controls the operation panel 13, and makes the liquid crystal panel display a quire setting scene for setting a quire page number "P".

When the operator operates the operation panel 13 to select a quire page number "P", the operation inputting section 22 inputs the quire page number "P", and the setting section 25 sets the inputted quire page number "P" into the setting value storing section 28 (Step S105). The setting section 25 sets a quire page number P=12 on the basis of the selection of the operator.

Next, the page calculating section 26 reads out the image page number "M" and the quire page number "P" from the setting value storing section 28, and calculates a quire number K=ceiling (M/P) (Step S106). The page calculating section 26 calculates a quire number K=3 on the basis of the image page number M=33 and the quire page number P=12, and sets it into the setting value storing section 28.

Further, the page calculating section 26 calculates an all page number N=K×P on the basis of the calculated quire number "K" and the read out quire page number "P" (Step S106). The page calculating section 26 calculates an all page number N=36, and sets it into the setting value storing section 28. This means that the all page number of a quire book after bookbinding is 36 pages. Because the image page number of the read manuscripts is M=33, the digital compound apparatus 10 should add blank paper pages to pages 34~36 of the book manuscripts.

After setting completion is informed from the page calculating section 26, the controlling section furthermore makes the operation panel 13 display a paper size value inputting scene for inputting a paper size value.

When the operator operates the operation panel 13 to select a paper long side value "x", a paper short side value "y" and a paper thickness value "t" as paper size values, the operation inputting section 22 inputs them. Then, the size obtaining section 27 obtains the paper long side value "x", the paper short side value "y", the paper thickness value "t" that are inputted, and sets them into the setting value storing section 28 (Step S107).

Next, the binding margin leading-out section 29 performs leading-out of binding margin values (Step S108). The binding margin leading-out section 29 leads out binding margin values that are different per page.

FIG. 8 is a diagram showing binding margins of a quire book.

Figure 8A:
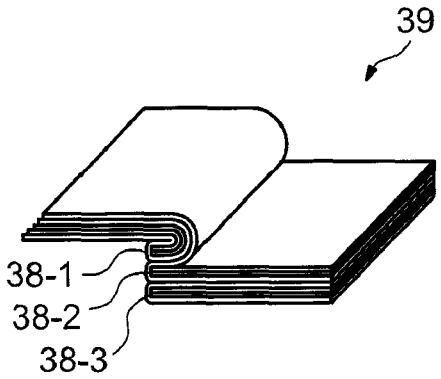
FIG. 8 is a diagram showing binding margins of a quire book.
Figure 8B:
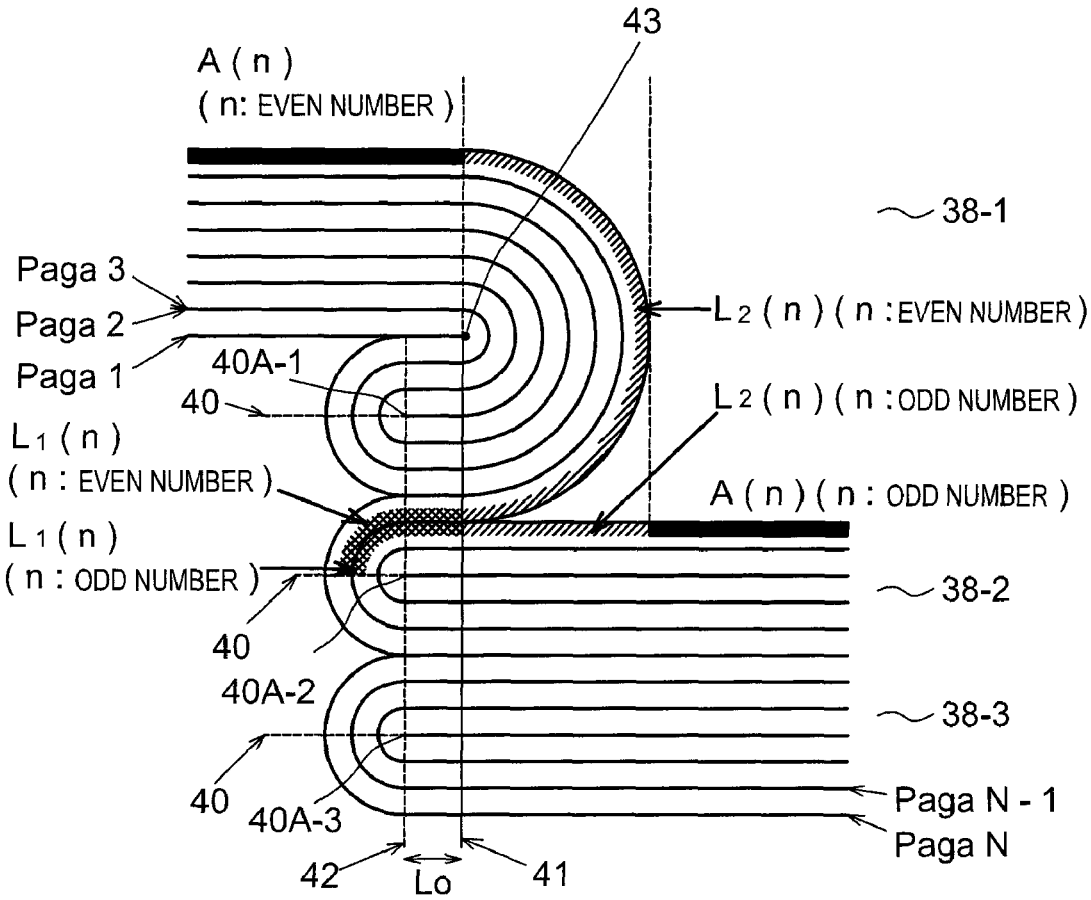

FIG. 8A is a squint diagram showing an appearance on which a quire book 39 that is composed of 3 quires 38-1, 38-2 and 38-3 is turned over; and FIG. 8B is a part magnification diagram of the side of the quire book 39 in FIG. 8A.

The binding margin value L (n) corresponding to the page number "n", as shown by FIG. 8B, is composed of the sum of the first binding margin value $L_1(n)$ that depends on which page of quires **38-*k* (k=1, 2, 3) is the present page and the second binding margin value $L_2(n)$ that depends on which page of whole quires 39 is the present page. The binding margin leading-out section 29** leads out a binding margin value $L(n)=L_1(n)+L_2(n)$ corresponding to the respective page number "n".

It is to explain about detail of a binding margin value leading-out process through the binding margin leading-out section 29 by following a flow chart.

Figure 9:
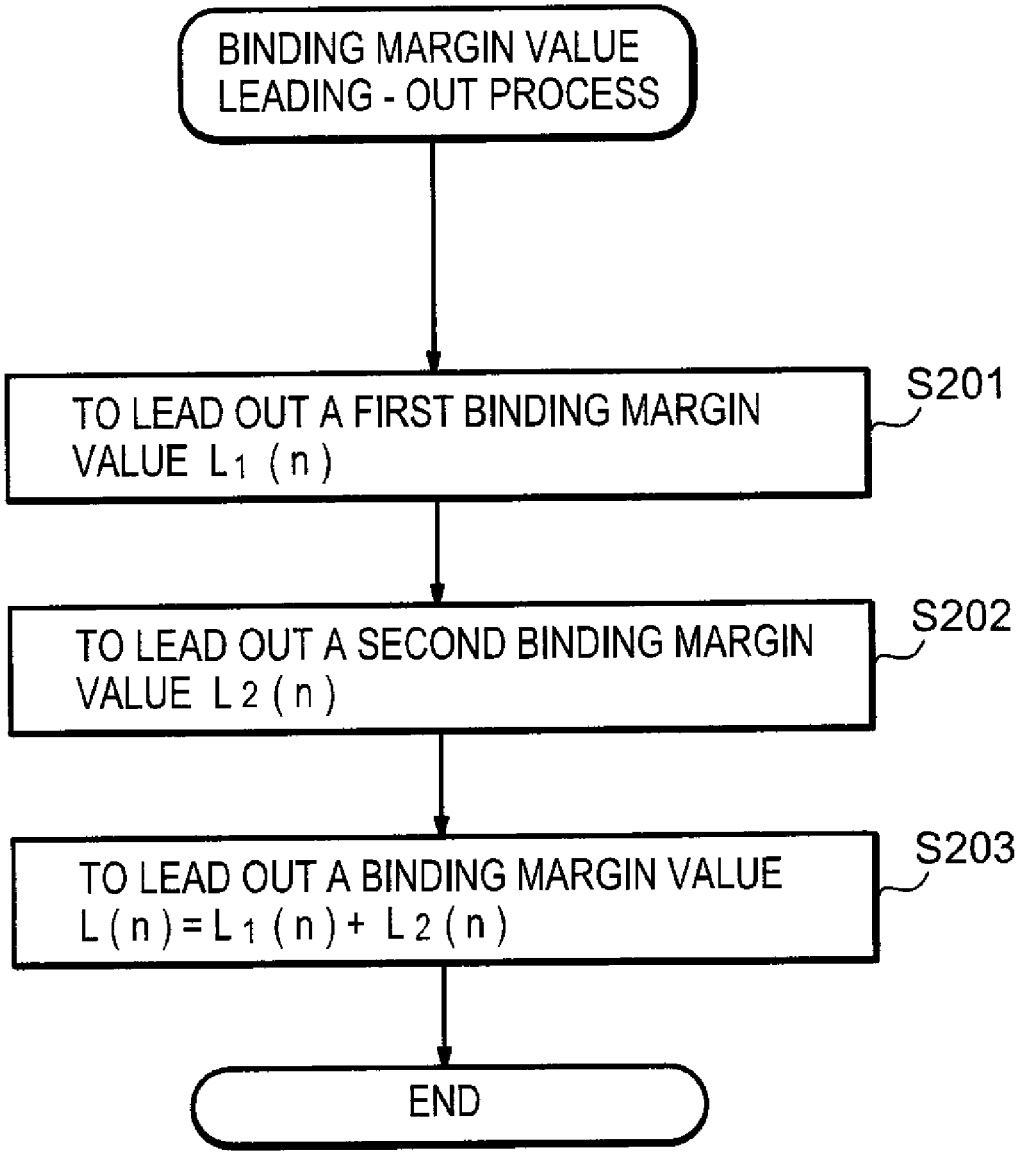
FIG. 9 is a flow chart for explaining a binding margin value leading-out operation of a digital compound apparatus in embodiment 1 of the present invention.

FIG. 9 is a flow chart for explaining a binding margin value leading-out operation of a digital compound apparatus in embodiment 1 of the present invention.

Here, it is to explain about a flow of leading out a binding margin value L(n) corresponding to the page number "n".

Firstly, the first leading-out section 35 leads out a first binding margin value $L_1(n)$ (Step S201).

As shown by FIG. 8B, the first binding margin value $L_1(n)$ corresponds to length from the folded position of the page corresponding to the page number "n", that is, a centerline 40 connecting the folded positions of the pages contained in the same quire to the binding position 41 at which the quire book 39 is bound. The binding position 41 is placed at a position of a fixed interval $L_0$ from a quire centerline 42 including folded positions 40A-1, 40A-2 and 40A-3 of the most inside pages in the respective quires 38-1, 38-2 and 38-3.

Moreover, in the present embodiment, for the interval $L_0$, although a fixed value that is previously determined is used, a designated value may also be used through an operation of the operation panel 13 by the operator.

When a quire number of the quire 38-*k* (k=1, 2, 3) in which the page corresponding to the page number "n" is contained is regarded as "k", the quire number "k" is calculated according to a formula k=ceiling(n/P).

The first leading-out section 35 calculates the first binding margin value $L_1(n)$ of the page corresponding to the page number "n" according to formulas (1-1)~(1-4) that are shown below (Step S201).

< mathematical expression 1 >

$$\text{when } (k-1)P+1 \le n \le \left(k-\frac{1}{2}\right)P,$$

$$L_1(n)=\begin{cases} L_0+\left\{\left(k-\frac{1}{2}\right)P-(n-1)\right\}\frac{t}{4}\pi & (n\text{: odd number}) \quad (1\text{-}1) \\ L_0+\left\{\left(k-\frac{1}{2}\right)P-n\right\}\frac{t}{4}\pi & (n\text{: even number}) \quad (1\text{-}2) \end{cases}$$

$$\text{when } \left(k-\frac{1}{2}\right)P+1 \le n \le kP,$$

$$L_1(n)=\begin{cases} L_0+\left\{(n-1)-\left(k-\frac{1}{2}\right)P\right\}\frac{t}{4}\pi & (n\text{: odd number}) \quad (1\text{-}3) \\ L_0+\left\{n-\left(k-\frac{1}{2}\right)P\right\}\frac{t}{4}\pi & (n\text{: even number}) \quad (1\text{-}4) \end{cases}$$

The first leading-out section 35 calculates the first binding margin value $L_1(n)$ on the basis of the page number "n" and the quire number "k" together with the quire page number "P" and the paper thickness value "t" that are set into the setting value storing section 28.

Here, an outline of a leading-out process of the formulas (1-1)~(1-4) stated above, is shown below.

A page number in the quire 38-*k* of the page corresponding to the quire number "k" and the page number "n", that is, a quire page number is defined as "n'". Further, with respect to the respective pages, when length of the folded part from the folded position to the quire centerline 42 is represented as "$L_1$'", the first binding margin value $L_1(n)$ is expressed as $L_1=L_0+L_1'$.

When the page corresponding to the quire number "k" and the quire page number "n'" is contained in the first half part of the quire 38-*k*, the quire page number "n'" meets 1≦n'≦P/2. With respect to respective pages which meet the condition formula, when the folded part from the folded position to the quire centerline 42 approximates to an arc that serves the folded position 40A-k of the quire 38-*k* as the center, length "$L_1$'" of the folded part is expressed by formulas (2-1)~(2-2) that are shown below by using the quire page number "n'".

< mathematical expression 2 >

$$\text{when } 1 \le n' \le \frac{P}{2},$$

$$L_1'(n')=\begin{cases} \left\{\frac{P}{2}-(n'-1)\right\}\frac{t}{4}\pi & (n\text{: odd number}) \quad (2\text{-}1) \\ \left\{\frac{P}{2}-n'\right\}\frac{t}{4}\pi & (n\text{: even number}) \quad (2\text{-}2) \end{cases}$$

Similarly, when the page corresponding to the quire number "k" and the quire page number "n'" is contained in the latter half part of the quire 38-*k*, the quire page number "n'" meets P/2+1≦n'≦P. With respect to respective pages which meet the condition formula, when the folded part from the folded position to the quire centerline 42 approximates to an arc that serves the folded position 40A-k of the quire 38-*k* as the center, the length "$L_1$'" of the folded part is expressed by formulas (2-3)~(2-4) that are shown below by using the quire page number "n'".

< mathematical expression 3 >

$$\text{when } \frac{P}{2}+1 \le n' \le P,$$

$$L_1'(n')=\begin{cases} \left\{(n'-1)-\frac{P}{2}\right\}\frac{t}{4}\pi & (n\text{: odd number}) \quad (2\text{-}3) \\ \left\{n'-\frac{P}{2}\right\}\frac{t}{4}\pi & (n\text{: even number}) \quad (2\text{-}4) \end{cases}$$

The quire page number "n'" is represented as n'=n−(k−1)×P by using the page number "n", the quire number "k" and the quire page number "P". The relation formula is replaced by respective formulas (2-1)~(2-2) stated above; and through adding $L_0$, formulas (1-1)~(1-4) are led out with respect to $L_1(n)$.

Next, the second leading-out section 36 leads out the second binding margin value $L_2(n)$ of the page corresponding to the page number "n" (Step S202).

As shown by FIG. 8B, the second binding margin value $L_2(n)$ corresponds to length of the margin region that is set from the binding position to the print region of the page corresponding to the page number "n". In the present embodiment, in order to make a nice-looking quire book, binding margins are set so that folded parts in the case to open respective pages and hidden parts obtained through laying respective pages at the folded parts become margin regions respectively.

The second leading-out section 36 calculates the second binding margin value $L_2(n)$ corresponding to the page number "n" according to formulas (3-1)~(3-4) that are shown below (Step S202).

< mathematical expression 4 >

$$\text{when } 1 \le n \le \frac{N}{2},$$

$$L_2(n) = \begin{cases} (n-1)\frac{t}{2} & (n\text{: odd number}) \quad (3\text{-}1) \\ (n-1)\frac{t}{4}\pi & (n\text{: even number}) \quad (3\text{-}2) \end{cases}$$

$$\text{when } \frac{N}{2} + 1 \le n \le N,$$

$$L_2(n) = \begin{cases} (N-n)\frac{t}{4}\pi & (n\text{: odd number}) \quad (3\text{-}3) \\ (N-n)\frac{t}{2} & (n\text{: even number}) \quad (3\text{-}4) \end{cases}$$

The second leading-out section 36 calculates the second binding margin value $L_2(n)$ on the basis of the page number "n", the all page number "N" and the paper thickness value "t" stored in the setting value storing section 28.

Here, an outline of a leading-out process of respective formulas (3-1)~(3-4) stated above, is shown below.

When the page corresponding to the quire number "n" is contained in the first half part of the quire book, the quire page number "n" meets $1 \leqq n \leqq N/2$. When the "n" is an even number, as shown by FIG. 8B, formula (3-2) is led out by approximating the folded part corresponding to the second binding margin value $L_2(n)$ of the page to an arc of surrounding semicircle that serves the folded position 43 of the page of the page number n=1 as the center. Further, when the "n" is an odd number, as shown by FIG. 8B, the second binding margin value $L_2(n)$ of the page becomes a length of a radius of the arc corresponding to the second binding margin value $L_2(n-1)$ of the page number "n−1", thus, formula (3-1) is led out. Even when the page corresponding to the page number "n" is contained in the latter half part of the quire book, formula (3-3) and formula (3-4) are led out similarly.

Continuously, the adding section 37 adds the first binding margin value $L_1(n)$ and the second binding margin value $L_2(n)$ to calculates the binding margin value $L(n)=L_1(n)+L_2(n)$ that corresponds to the page number "n" (Step S203). Thus, the leading-out process of the binding margin value corresponding to the page number "n" is completed through the binding margin leading-out section 29.

As stated above, corresponding to the respective page number "n", the first binding margin value $L_1(n)$ and the second binding margin value $L_2(n)$ are led out, they are added, and the binding margin value L(n) is led out.

Returning to the flow chart of FIG. 6 and FIG. 7, after the binding margin value L(n) is led out (Step S108), the determining section 30 determines the print region A(n) corresponding to the page number "n" on the basis of the led out binding margin value L (n) and the paper size value that is set into the setting value storing section 28 (Step S109). Hereinafter, it is to explain about a flow of determining print regions A(n).

FIG. 10 is a diagram showing a determination example of print regions.

Figure 10A:
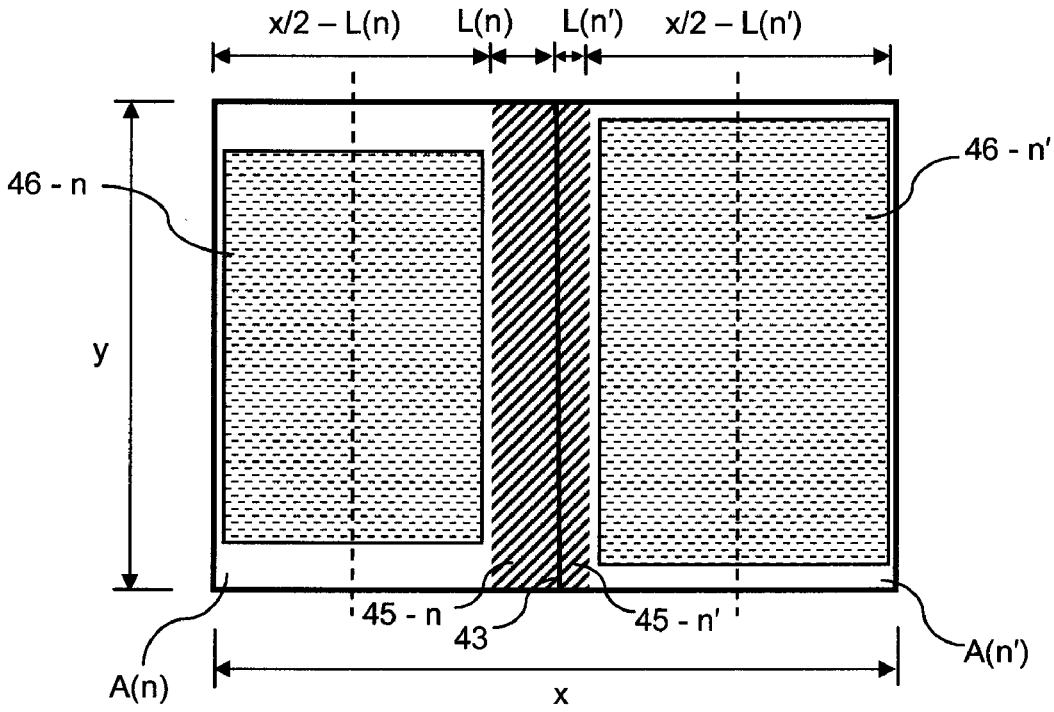
FIG. 10 is a diagram showing a determination example of print regions.

In the paper, that is shown by FIG. 10A, the left side corresponds to the page of the page number "n"; and the right side corresponds to the page of page number "n'". Binding margin values led out with respect to the respective pages are represented as L(n) and L(n').

The determining section 30 reads out the paper long side value "x" and the paper short side value "y" from the setting value storing section 28. The paper long side value "x" and the paper short side value "y" are respectively shown by FIG. 10B.

When the paper is saddle stitched and bound at the centerline 44 of the long side direction, with respect to the size of the respective pages, as shown by FIG. 10A, the long side value equals the paper short side value "y"; and the short side value becomes a half of the paper long side value, that is, "x/2".

The determining section 30 determines a rectangular region A (n) excluding a binding margin part 45-*n*, as a print region of the paper corresponding to the page number "n". The determining section 30 serves a region long side value $A_x(n)$ of the print region A(n) as the paper short side value "y", and serves a region short side value $A_y(n)$ as a value that the binding margin value L (n) is subtracted from the half of the paper long side value "x", that is, "x/2". That is, the determining section 30 calculates the region long side value $A_x(n)$ and the region short side value $A_y(n)$ according to formula $A_x(n)=y$ and formula $A_y(n)=x/2-L(n)$, and makes the setting value storing section 28 store the region long side value $A_x(n)$ and the region short side value $A_y(n)$ that are calculated.

Similarly, a print region A(n') with respect to the page number "n'" is also determined as a rectangular region excluding a binding margin part 45-*n'*.

Continuously, the determining section 30 reads out the image page number "M" from the setting value storing section 28, and compares the image page number "M" and the page number "n" (Step S110). When the page number "n" is smaller than the image page number "M", that is, n<M, the determining section 30 judges that there is a page of not being processed. Then, the binding margin leading-out section 29 leads out the binding margin value L (n+1) corresponding to the page number "n+1" (Step S108).

In the Step S110, when the page number "n" equals the image page number "M", that is, n=M, the determining section 30 judges that there is no page of not being processed, that is, the determination of all the print regions A(n) corresponding to the respective page numbers "n" has been completed, and performs a calculation instruction for the magnification/reduction rate calculating section 31.

The magnification/reduction rate calculating section 31 calculates magnification/reduction rates R(n) corresponding to the respective page numbers "n". Then, the changing section 32 magnifies/reduces image of respective pages on the basis of the magnification/reduction rates R(n), and generates change image data (Step S111). The calculation of the magnification/reduction rates R(n) and the generation of the change image data are performed as stated below.

The magnification/reduction rate calculating section 31 reads out the page long side value "X" and the page short side value "Y" as the page size value from the image storing section 24; and reads out the region long side value $A_x(n)$ and the region short side value $A_y(n)$ that correspond to the page number "n" from the setting value storing section 28. Then, the magnification/reduction rate calculating section 31 calculates a long side magnification/reduction rate $R_x(n)=A_x(n)/X$ and a short side magnification/reduction rate $R_y(n)=A_y(n)/Y$. Continuously, the magnification/reduction rate calculating section 31 compares the long side magnification/reduction rate $R_x(n)$ and the short side magnification/reduction rate $R_y(n)$ that are calculated, selects a smaller value as the magnification/reduction rate R(n) corresponding to the page number "n", and informs the changing section 32 of it.

For example, in the page corresponding to the page number "n" shown by FIG. 10A, when $R_x(n)>R_y(n)$, the magnification/reduction rate calculating section 31 selects $R(n)=R_y$ (n)={X/2−L(n)}/Y as the magnification/reduction rate, and informs the changing section 32 of it.

The changing section 32, after informed of the magnification/reduction rate R(n), reads out the image data corresponding to the page number "n" from the image storing section 24, magnifies/reduces the image data on the basis of the magnification/reduction rate R(n), and generates change image data.

At this time, the change image data corresponding to the page number "n" is magnified/reduced so as to adjust to the region short side value $A_y(n)$. Therefore, the page size of the change image data, as shown by FIG. 10A, becomes the size of a region 46-*n* that is accommodated within the print region A(n). Further, the change image data corresponding to the page number "n'" is magnified/reduced so as to adjust to the region short side value $A_y(n')$, and the page size of the change image data becomes the size of a region 46-*n'*.

As stated above, after the change image data corresponding to the respective page numbers "n" are generated (Step S111), the replacing and generating section 33 replaces a page order of the change image data corresponding to the respective page numbers "n" (n=1, 2, . . . , 33) with a print order, and generates bookbinding print data (Step S112). The replacing and generating section 33 performs an arrangement of pages to respective papers so that book manuscripts after saddle stitching and bookbinding become in order of the page number "n".

Figure 11:
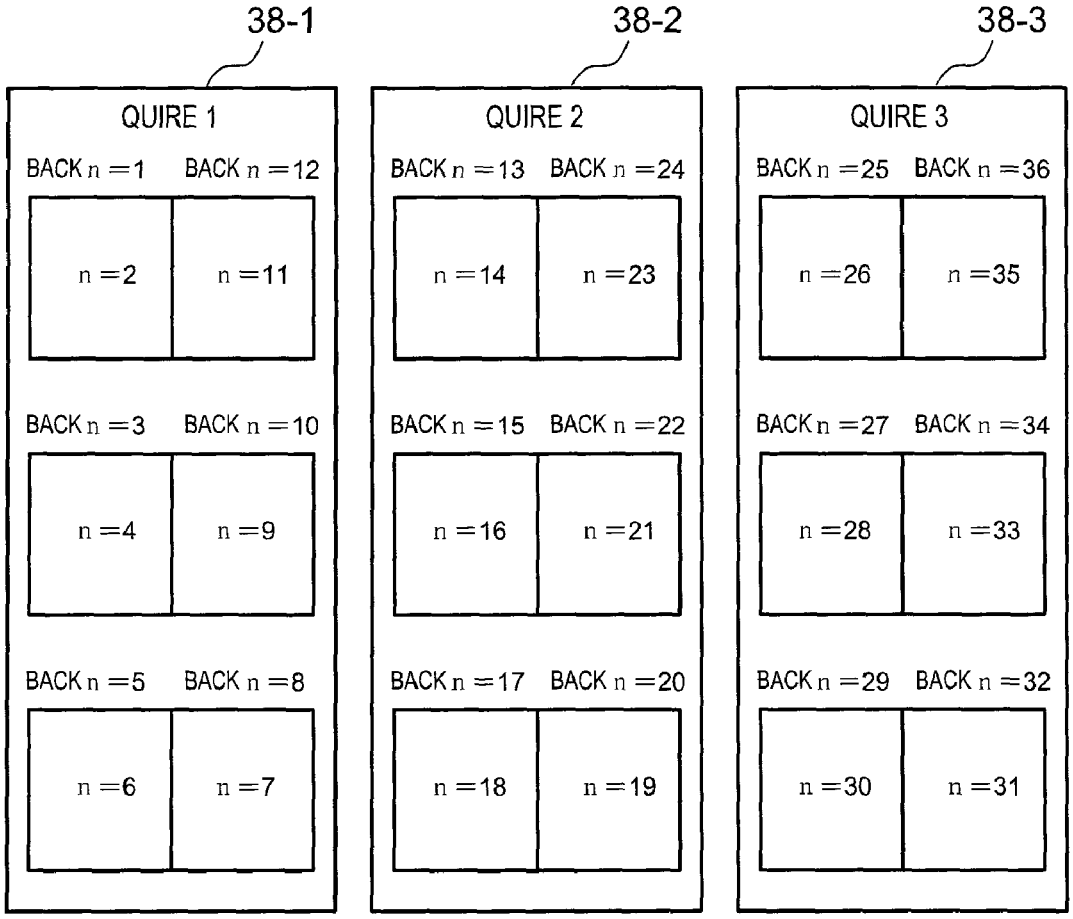
FIG. 11 is a diagram showing an arrangement example of respective pages on a quire book.

FIG. 11 is a diagram showing an arrangement example of respective pages on a quire book.

FIG. 11 corresponds to the case of the quire page number P=12 and the all page number N=36, and a page arrangement example is shown in the both sides of 3 sheets of papers contained in the respective quires 38-1, 38-2 and 38-3.

For example, on the first sheet of papers of the quire 38-1, as shown by FIG. 11, the page corresponding to the page number n=2 is arranged in the left part of the front side, and the page corresponding to the page number n=11 is arranged in the right part of the front side. Further, in the back side of the paper 47-1, the page corresponding to the page number n=1 is arranged in the back side of the page corresponding to the page number n=2 and the page corresponding to the page number n=12 is arranged in the back side of the page corresponding to the page number 11, respectively.

Moreover, because the image page number of the read manuscripts is M=33, in parts corresponding to the page number n=34, 35 and 36, blank pages are arranged.

As stated above, the replacing and generating section 33 performs an arrangement of the respective pages. At this time, the replacing and generating section 33 performs a page arrangement so that image center positions of the change image data corresponding to the respective page numbers "n" are consistent with the center of the print regions A(n).

For example, as shown by FIG. 10A, the region 46-*n* corresponding to the change image data of the page number "n" is arranged so that the centerline of the short side direction of the region is consistent with the centerline of the short side direction of the print region A(n), and the same amount of margin is set into the both sides of the long side direction.

The replacing and generating section 33, as stated above, performs arrangements of respective pages, and generates image data corresponding to both sides of 9 sheets of papers as bookbinding print data (Step S112).

Then, the outputting section 34 outputs the bookbinding print data to the image forming section 21.

After the bookbinding print data is inputted from the image processing section 14, the image forming section 21 forms images in the both sides of respective paper on the basis of the bookbinding print data, and outputs book manuscripts (Step S113). The image forming section 21 forms toner images of bookbinding print data, transfer them in order on respective papers, and generates book manuscripts that are composed of 9 sheets of print completion paper. Thus, the book manuscript generating process is completed in the digital compound apparatus 10.

As stated above, book manuscripts of a quire book composed of a plurality of quires are generated.

As stated above, in the digital compound apparatus of the present embodiment, because the first binding margin value that is dependent on each quire, and the second binding margin value that is dependent on the all page number of the quire book, are led out, they are added, and then the binding margin value of each page is led out, so it is possible to determine print regions of respective pages by adjusting the binding margin value for each page. Therefore, even when a plurality of quires are saddle stitched and bound into a quire book, it is possible to perform bookbinding of a quire book that looks nice.

Moreover, in the present embodiment, the magnification/reduction rate calculating section 31 performs a selection of magnification/reduction rates R(n) corresponding to the respective page numbers "n", then the changing section 32 generates change image data on the basis of the magnification/reduction rates R(n). However, the present invention is not limited to the case. For example, when a common magnification/reduction rate R(n) of all pages is selected, it is possible to generate change image data on the basis of the common magnification/reduction rate R(n).

Figure 10B:
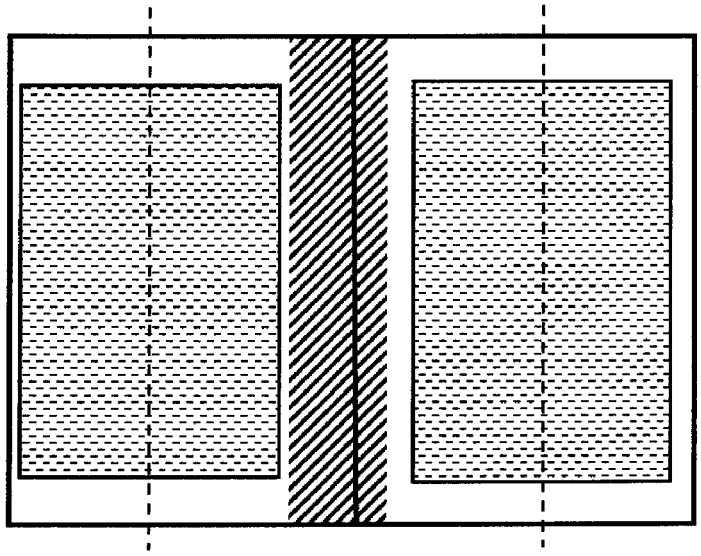

FIG. 10B shows a case that the calculated magnification/reduction rate R(n) with respect to the page of the left side is selected as a common magnification/reduction rate R(n) for all pages.

At this time, the magnification/reduction rate calculating section 31 compares the calculated magnification/reduction rates R(n) corresponding to respective page numbers "n", and selects the smallest magnification/reduction rate as the common magnification/reduction rate "R" for all pages. Or by comparing binding margin values L(n), it may also calculate a magnification/reduction rate R(n) corresponding to the biggest binding margin value L(n) as the common magnification/reduction rate "R". Like this, through selecting a common magnification/reduction rate for all pages, it is possible to possess image sizes of all pages, furthermore, to perform bookbinding of a quire book that looks nice.

Further, in the present embodiment, the determining section 30 serves the whole region excluding binding margin parts of respective pages as print regions of the page. However, the present invention is not limited to the case. For example, it is also possible to set margin regions in side parts of papers. At this time, a margin length storing section 28*a* is newly set up in the setting value storage section 28 for previously storing length of margin regions as a margin length, the determining section 30 performs a determination of print regions on the basis of the stored margin length and the led out binding margin values.

<Embodiment 2>

Figure 12:
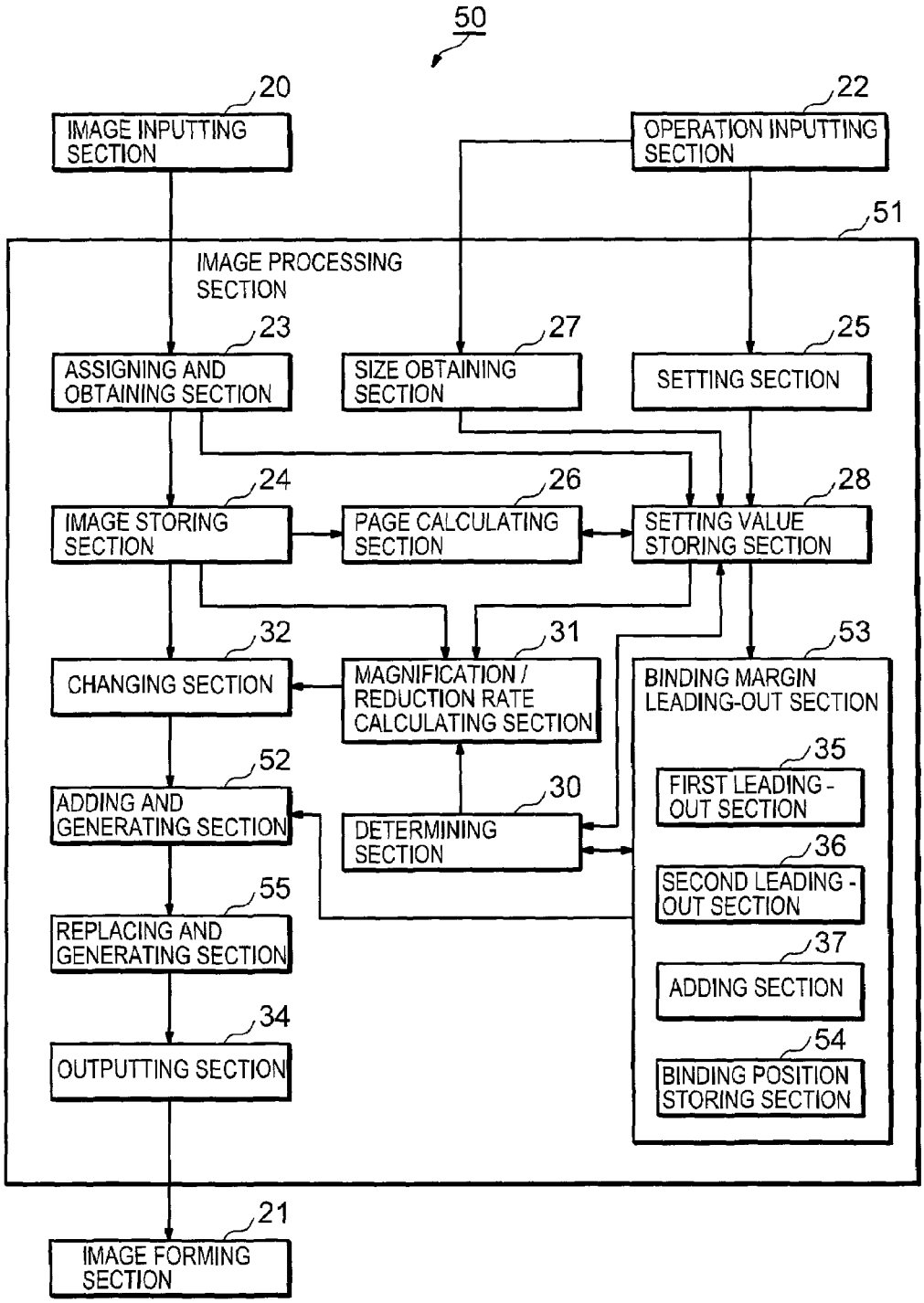
FIG. 12 is a block diagram showing a function structure of a digital compound apparatus in embodiment 2 of the present invention.

FIG. 12 is a block diagram showing a function structure of a digital compound apparatus in embodiment 2 of the present invention.

The digital compound apparatus 50 of the present embodiment has a different structure in which an adding and generating section 52 is added in an image processing section 51; and a binding position storing section 54 is added in a binding margin leading-out section 53 from the one in embodiment 1.

Moreover, in the present embodiment, the same structures as the embodiment 1 are shown by the same marks, so detailed explanation about them is omitted.

The digital compound apparatus 50, as shown by FIG. 12, comprises an image inputting section 20, an image forming section 21, an operation inputting section 22 and an image processing section 51.

The image processing section 51, as shown by FIG. 12, includes an assigning and obtaining section 23, an image storing section 24, a setting section 25, a page calculating section 26, a size obtaining section 27, a setting value storing section 28, a binding margin leading-out section 53, a determining section 30, a magnification/reduction rate calculating section 31, a changing section 32, an adding and generating section 52, a replacing and generating section 55 and an outputting section 34.

The binding margin leading-out section 53 has a first leading-out section 35, a second leading-out section 36, an adding section 37 and a binding position storing section 54, and leads out binding margin values L(n) corresponding to respective page numbers "n" as a leading-out section.

The binding position storing section 54 is a storing section for storing first binding margin values $L_1(n)$ led out by the first leading-out section 35 corresponding to respective page numbers "n".

The adding and generating section 52 generates binding position image data for adding binding position representation lines or binding position representation marks that represent binding position in respective papers corresponding to respective page numbers "n" on the basis of the first binding margin values $L_1(n)$ stored in the binding position storing section 54.

Further, the adding and generating section 52 synthesizes change image data and the binding position image data corresponding to respective page numbers "n", and generates addition change image data in which the binding position representation lines or the binding position representation marks are added.

The replacing and generating section 55 replaces a page order of the addition change image data corresponding to respective page numbers "n" in a print order, and generates bookbinding print data.

Next, it is to explain operation of the digital compound apparatus 50 of the present embodiment.

Figure 13:
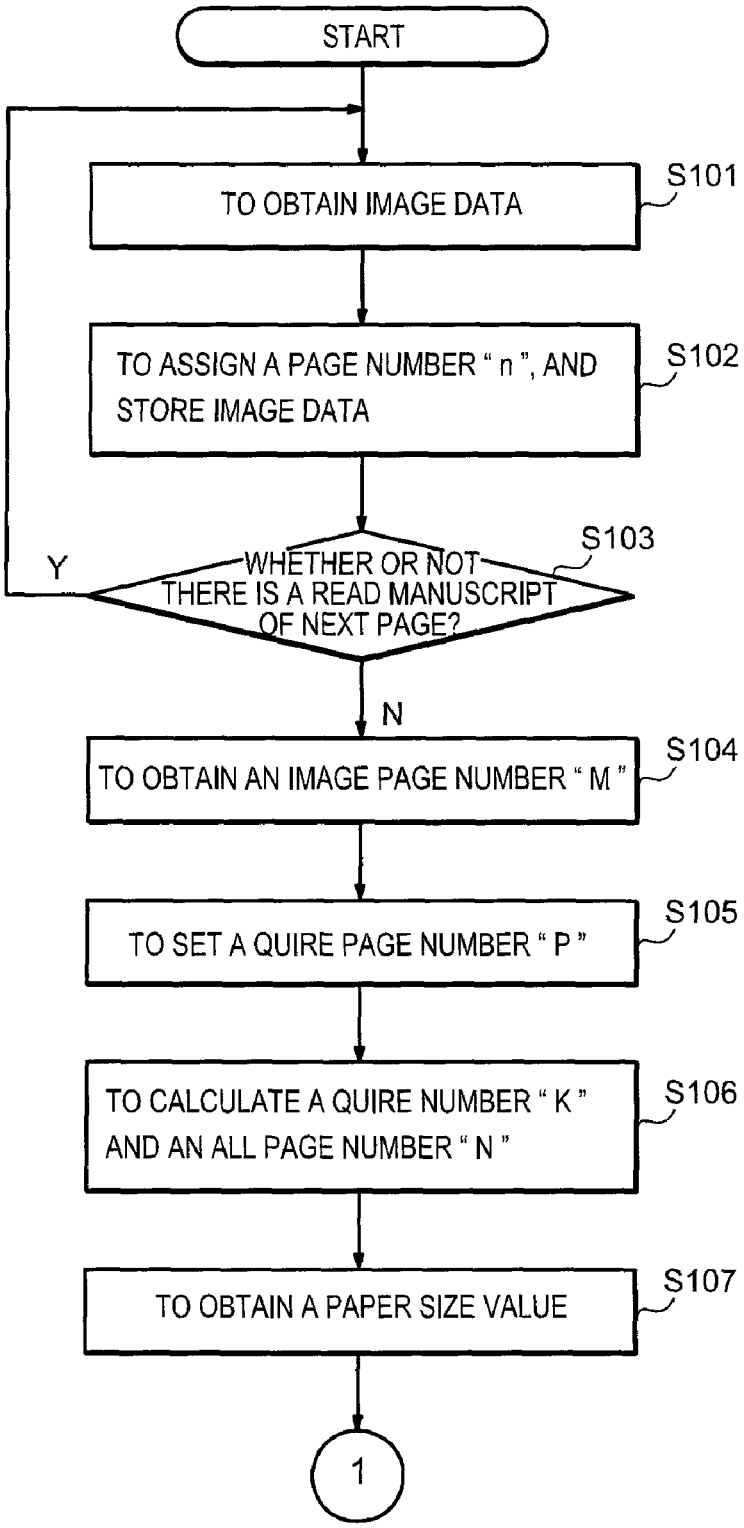
FIG. 13 is a first flow chart for explaining a book manuscript generating operation of a digital compound apparatus in embodiment 2 of the present invention.
Figure 14:
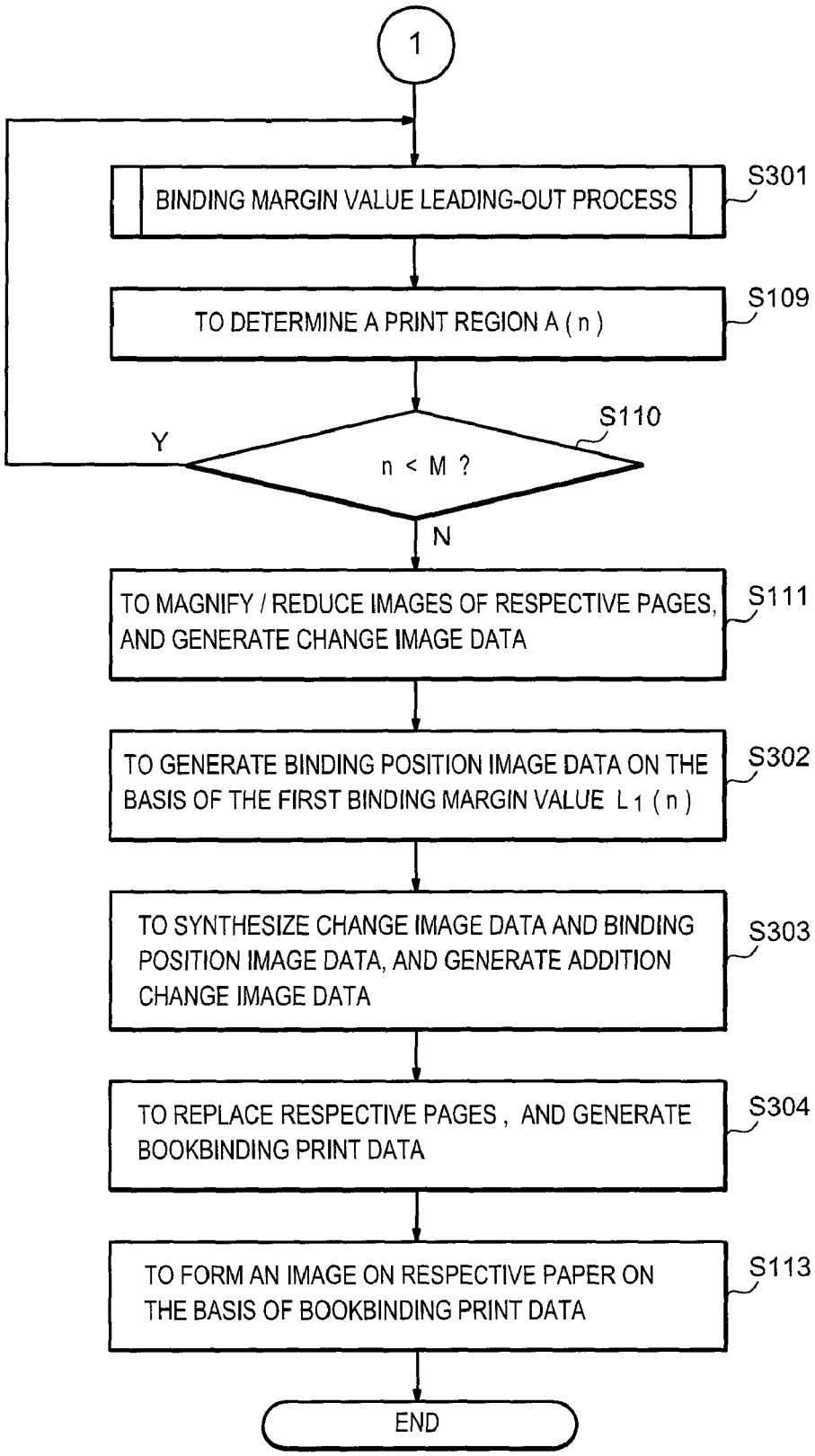
FIG. 14 is a second flow chart for explaining a book manuscript generating operation of a digital compound apparatus in embodiment 2 of the present invention.

Here, it is to explain about a flow of generating and outputting a book manuscript for a quire book by reading a plurality of sheets of read manuscripts by a flow chart shown in FIG. 13 and FIG. 14.

FIG. 13 is a first flow chart for explaining a book manuscript generating operation of a digital compound apparatus in embodiment 2 of the present invention; and FIG. 14 is a second flow chart for explaining a book manuscript generating operation of a digital compound apparatus in embodiment 2 of the present invention.

In the digital compound apparatus 50, the image inputting section 20 reads images of read manuscripts in an order of every one sheet, and obtains and inputs image data (Step S101).

After the image data is inputted to the image processing section 14, the assigning and obtaining section 23 assigns page numbers "n" to the image data; and obtains page size values of the image data, and then makes the image storing section 24 store them (Step S102).

Then, the image inputting section 20 judges whether or not there is a read manuscript of the next page part (Step S103), after judged that there is a read manuscript of the next page part, it obtains and inputs image data of the read manuscript (Step S101).

After it is judged that there is no read manuscript of the next page part (Step S103), the assigning and obtaining section 23 obtains an image page number "M", and sets the image page number "M" into the setting value storing section 28 (Step S104).

Continuously, the operation panel 13 displays a quire setting scene. Then, the operation inputting section 22 inputs a quire page number "P" on the basis of the operation of the operator, and the setting section 25 sets the quire page number "P" into the setting value storing section 28 (Step S105).

Then, the page calculating section 26 reads out the image page number "M" and the quire page number "P" from the setting value storing section 28, and calculates a quire number K=ceiling(M/P) (Step S106).

Further, the page calculating section 26 calculates an all page number N=K×P on the basis of the quire number "K" and the quire page number "P" and sets the all page number "N" into the setting value storing section 28 (Step S106).

Next, the operation panel 13 displays a paper size value inputting scene. Then, the operation inputting section 22 inputs paper size values on the basis of the operation of the operator. Continuously, the size obtaining section 27 obtains the inputted paper size values, and sets them into the setting value storing section 28 (Step S107).

Next, the binding margin leading-out section 53 performs leading-out of binding margin values (Step S301). Hereinafter, it is to simply explain a flow of leading out binding margin value L(n) corresponding to a page number "n".

Figure 15:
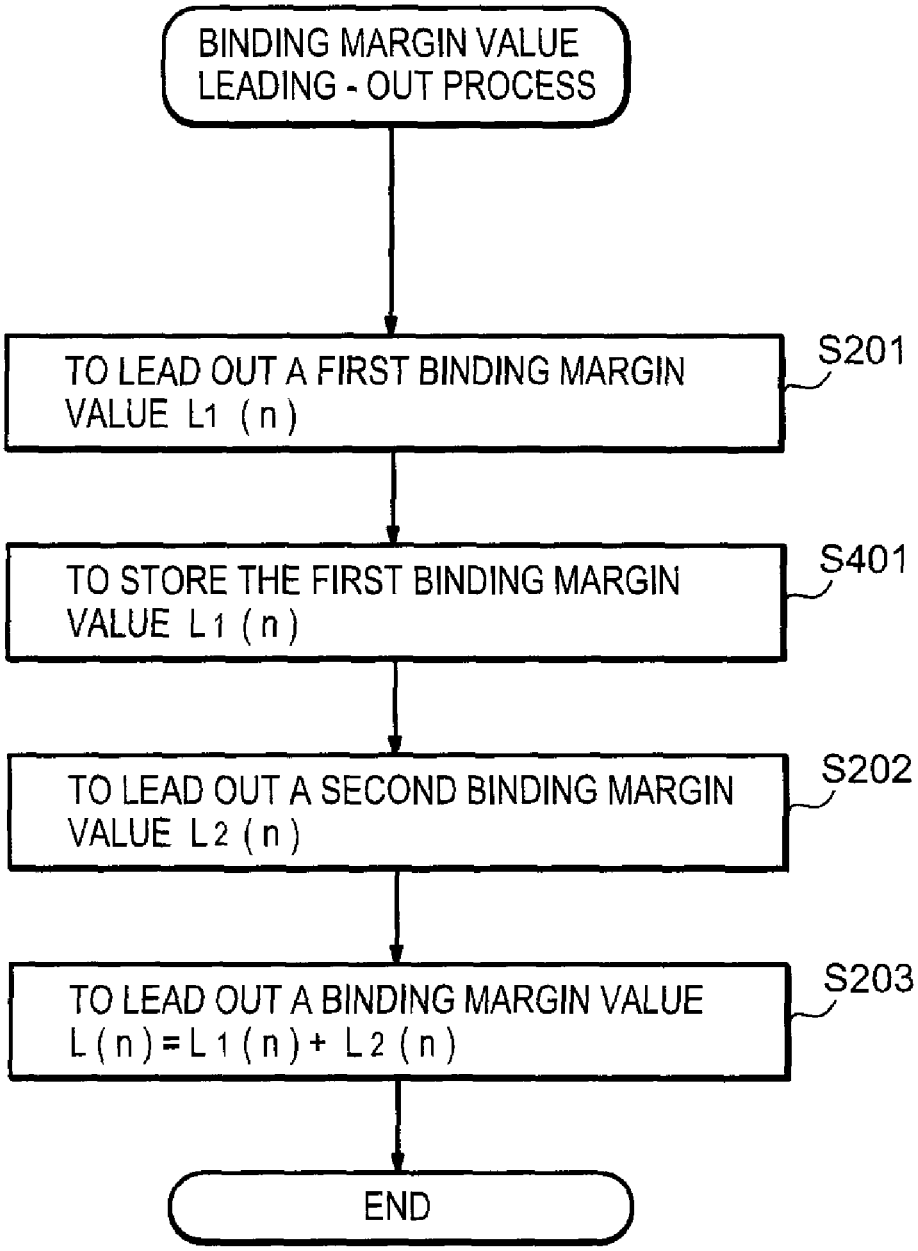
FIG. 15 is a flow chart for explaining a binding margin value leading-out operation of a digital compound apparatus in embodiment 2 of the present invention.

FIG. 15 is a flow chart for explaining a binding margin value leading-out operation of a digital compound apparatus in embodiment 2 of the present invention.

Firstly, the first leading-out section 35 leads out a first binding margin value $L_1(n)$ corresponding to the page number "n" (Step S201). The first leading-out section 35 calculates a quire number k=ceiling(n/P), and calculates the first binding margin value $L_1(n)$ according to formulas (1-1)~(1-4) on the basis of the quire number "k", the quire page number "P" and the paper thickness value "t" that are set into the setting value storing section 28, together with the page number "n".

Continuously, the binding position storing section 54 stores the led out first binding margin value $L_1(n)$ to correspond to the page number "n" (Step S401).

Next, the second leading-out section 36 leads out a second binding margin value $L_2(n)$ corresponding to the page number "n" (Step S202). The second leading-out section 36 calculates the second binding margin value $L_2(n)$ according to formulas (3-1)~(3-4) on the basis of the page number "n", together with the all page number "N" and the paper thickness value "t" that are set into the setting value storing section 28.

Then, the adding section 37 adds the first binding margin value $L_1(n)$ and the second binding margin value $L_2(n)$, and calculates a binding margin value $L(n)=L_1(n)+L_2(n)$ corresponding to the page number "n" (Step S203). Thus, the leading-out process of the binding margin value L(n) is completed through the binding margin leading-out section 53.

Returning to the flow chart of FIG. 13 and FIG. 14, after the binding margin value L(n) corresponding to the page number "n" is led out by the binding margin leading-out section 53 (Step S301), the determining section 30 determines a print region A(n) corresponding to the page number "n" on the basis of the led out binding margin value L(n) and the paper size value that is set into the setting value storing section 28 (Step S109).

Continuously, the determining section 30 reads out the image page number "M" from the setting value storing section 28, compares the image page number "M" and the page number "n", and judges whether or not there is a page of not being processed (Step S110). When n<M, the determining section 30 judges that there is a page of not being processed, and the binding margin leading-out section 29 leads out a binding margin value L(n+1) corresponding to a page number "n+1" (Step S301).

When n=M (Step S3110), the determining section 30 judges that there is no page of not being processed. Then, the magnification/reduction rate calculating section 31 performs a calculation of magnification/reduction rates R(n) corresponding to the respective page numbers "n", and the changing section 32 magnifies/reduces images of respective papers on the basis of the magnification/reduction rates R(n), and generates change image data (Step S111).

Further, the adding and generating section 52 reads out the first binding margin value $L_1(n)$ stored in the binding position storing section 54, and generates folding position image data on the basis of the first binding margin value $L_1(n)$ (Step S302).

Here, it is to explain about generation of the bending position image data through the adding and generating section 52 by using FIG. 16.

FIG. 16 is a diagram showing an addition example of binding position representation lines and binding position representation marks.

Figure 16A:
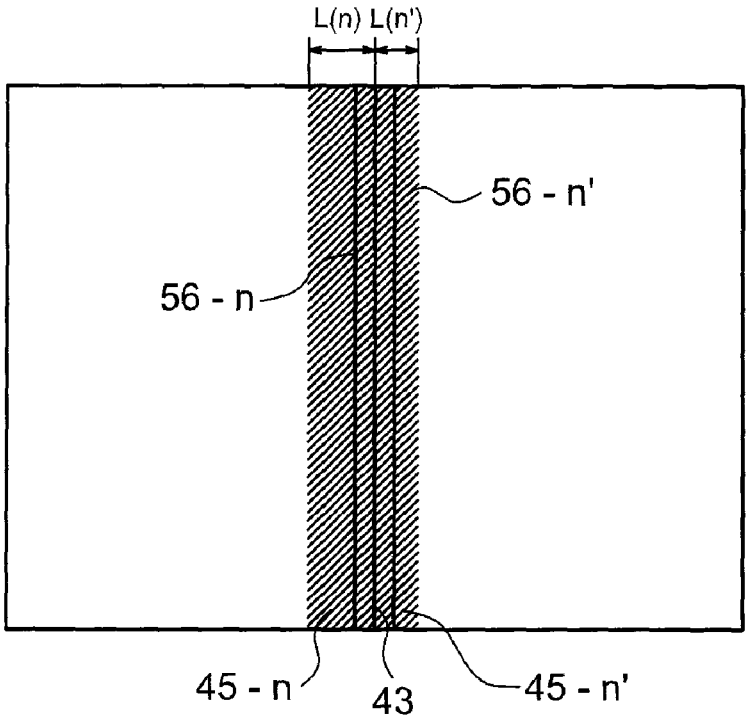
FIG. 16 is a diagram showing an addition example of binding position representation lines and binding position representation marks.
Figure 16B:
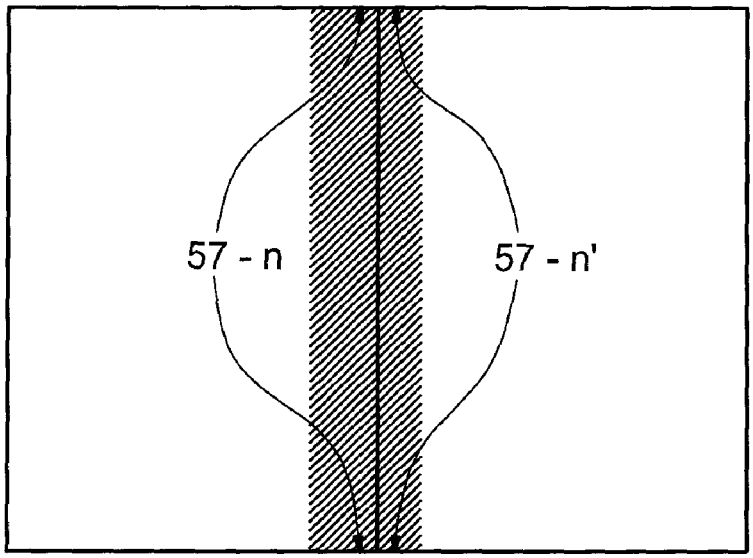

FIG. 16A is a diagram showing binding position representation lines added in the outside pages of respective quires; and FIG. 16B is a diagram showing binding position representation marks added in the inside pages.

As shown by FIG. 16A and FIG. 16B, the left side page of the paper corresponds to the page number "n", and the right side corresponds to the page number "n'".

The adding and generating section 52, firstly, judges whether or not the page corresponding to the page number "n" is an outside page of the quire. The adding and generating section 52 judges whether or not the page number "n" and the quire number "k" corresponding to the page meet any one of relation formulas n=(k−1)×P+1 and n=k×P. Here, "P" is the quire page number that is set into the setting value storing section 28.

When any one of relation formulas is met, the adding and generating section 52 judges that the page corresponding to the page number "n" is an outside page of the quire of the quire number "k". Then, the adding and generating section 52 generates corresponding binding position image data in order to add a binding position representation line 56-*n* shown in FIG. 16A to the page.

When any one of relation formulas is not met, the adding and generating section 52 judges that the page corresponding to the page number "n" is an inside page of the quire of the quire number "k". Then, the adding and generating section 52 generates corresponding binding position image data in order to add binding position representation marks 57-*n* shown in FIG. 16B to the page.

As stated above, the adding and generating section 52 generates the binding position image data corresponding to the respective page numbers "n". A page corresponding to the page number "n'" which is arranged on the same side of the paper as the page that is judged to be an outside page is judged to be an outside page and, as shown by FIG. 16A, binding position image data corresponding to the binding position representation line 56-*n*' is generated. Similarly, a page corresponding to a page number "n'" which is arranged on the same side of the paper as the page that is judged to be an inside page is judged to be an inside page and, as shown by FIG. 16B, binding position image data corresponding to binding position representation marks 57-*n*' is generated.

Continuously, the adding and generating section 52 synthesizes the change image data and the binding position image data corresponding to the respective page numbers "n", and generates addition change image data in which binding position representation lines or binding position representation marks are added (Step S303).

Then, the replacing and generating section 55 replaces a page order of the addition change image data corresponding to the respective page numbers "n" in a print order, and generates bookbinding print data (Step S304), and then the outputting section 34 outputs the bookbinding print data to the image forming section 21.

The image forming section 21 forms images on the both sides of respective papers on the basis of the bookbinding print data inputted from the image processing section 51, and outputs book manuscripts (Step S113). Thus, the book manuscript generating process is completed in the digital compound apparatus 50.

As stated above, the book manuscripts of a quire book in which binding position representation lines and binding position representation marks are added, are generated.

Figure 17:
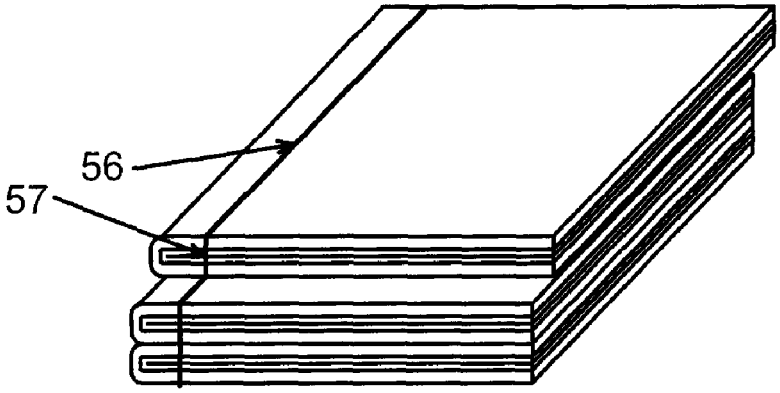
FIG. 17 is a diagram showing a quire book in embodiment 2.

FIG. 17 is a diagram showing a quire book in embodiment 2.

In respective pages of the quire book, because binding position representation lines 56 or binding position representation marks 57 are added, as shown by FIG. 17, so it becomes possible to see binding positions from the surface and sides of the quire book.

As stated above, according to the digital compound apparatus of the present embodiment, an operator can confirm binding positions by seeing binding position representation lines and binding position representation marks added on papers of book manuscripts. Therefore, even when the digital compound apparatus has no bookbinding function such as a saddle stitching finisher and the operator must operates a bookbinding work manually, an occurrence of a gap between binding positions is prevented, and it becomes possible to make a nice-looking quire book easily.

The Utilization Possibility in Industry:

In respective embodiments stated above, as the present invention, it is to explain examples of a digital compound apparatus in which a printer and an image processing section are provided. However, the present invention is not limited to the case. For example, it is also possible to apply the present invention to a facsimile apparatus, a copy apparatus and the like. Further, it is also possible to form an image forming apparatus by connecting a printer as an image forming section in a personal computer as an image processing apparatus.

Figure 18:
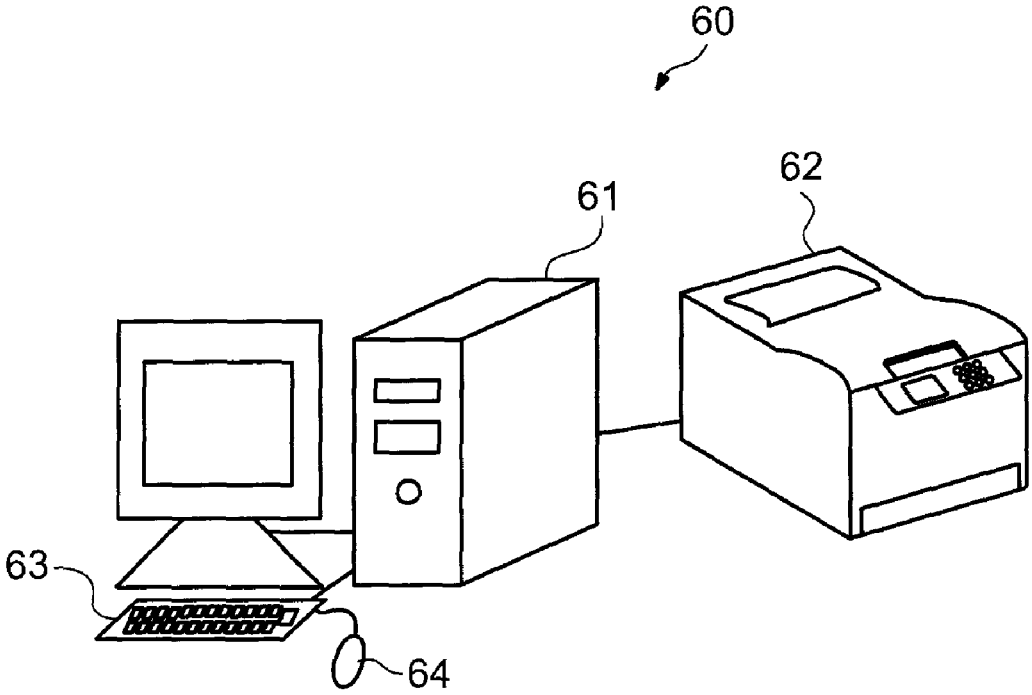
FIG. 18 is a diagram showing a change example of an image forming apparatus of the present invention.

FIG. 18 is a diagram showing a change example of an image forming apparatus of the present invention.

An image forming apparatus 60 comprises a personal computer 61 as an image processing apparatus, and a printer 62 as an image forming section that is connected with the personal computer 61. In the personal computer 61, furthermore, a keyboard 63 and a mouse 64 are connected as an operation inputting section.

Further, in respective embodiments stated above, the operation inputting section performs an input of paper size values, but the present invention is not limited to the case. It is also possible to input paper classification information that represents classification of papers using for bookbinding print. The operation inputting section inputs, for example, paper size information such as "A4", "A3", "B4" and the like for designating paper sizes, and paper thickness information such as "thick", "thin" and the like for designating paper thickness. The image processing section previously stores combinations of paper long side values and paper short side values that correspond to respective paper size information, and previously stores paper thickness values that correspond to respective paper thickness information. Then, the size obtaining section reads out and obtains respective paper size values on the basis of the paper size information and the paper thickness information that are inputted. At this time, even if the operator dose not input concrete paper size values, the operator may perform only classification designation of using papers, therefore convenience is improved; and the occurrence of bad condition is prevented because of wrong inputs of values.

The present invention is not limited to the foregoing embodiments but many modifications and variations are possible within the spirit and scope of the appended claims of the invention.

What is claimed is:

1. An image processing apparatus, having an image inputting section for inputting image data, saddle stitches respective quires that are made by folding print mediums and processes image data for binding a plurality of quires into a quire book, each quire having a plurality of pages, the image processing apparatus comprising:

a setting section that sets a quire page-count of each quire;

a size obtaining section that obtains medium size information of the print mediums;

an assigning and obtaining section that assigns respective quire-book page number to each page of the inputted image data, and obtains an image page-count;

a page calculating section that calculates a quire-book page-count on the basis of the quire page-count and the image page-count;

a determining section that respectively determines a print region corresponding to the respective quire-book page number on the basis of the quire page-count, the medium size information and the quire-book page-count; and a changing section that respectively changes each page of the image data to change image data scaled to fit within the print region determined with respect to the corresponding quire-book page number, wherein a first binding margin value is determined by the determining section based on a quire page number in a single quire, a second binding margin value is determined by the determining section based on the quire-book page number, and a binding margin value corresponding to each quire-book page number is calculated by the determining section based on the first and second binding margin values, and wherein the first and second binding margin values in odd-numbered pages and the first and second binding margin values in even-numbered pages are calculated by the determining section using different formulae respectively.

2. The image processing apparatus according to claim 1, further comprising: a replacing and generating section that replaces a page order of the respective change image data so that the replaced page order corresponds with a page order of the quire book after bookbinding, and generates bookbinding print data; and an outputting section that outputs the generated bookbinding print data.

3. The image processing apparatus according to claim 1, wherein each page of the image data inputted through the image inputting section is composed of RGB bit map data.

4. The image processing apparatus according to claim 1, further comprising: an operation inputting section that inputs the quire page-count that is contained in a set of quires on the basis of an operation of an operator, wherein the setting section sets the inputted quire page-count.

5. The image processing apparatus according to claim 1, wherein the medium size information is composed of a long side size, a short side size and a medium thickness size of the print medium.

6. The image processing apparatus according to claim 1, further comprising:

a medium information storing section that stores medium size information corresponding to medium classification information representing classifications of respective print mediums; and an operation inputting section that inputs medium classification information on the basis of an operation of an operator, wherein the size obtaining section obtains corresponding medium size information from the medium information storing section on the basis of the inputted medium classification information.

7. The image processing apparatus according to claim 1, wherein the size obtaining section consists of a detecting section for detecting medium size information of the respective print mediums.

8. The image processing apparatus according to claim 7, wherein the detecting section consists of a sensor that is furnished in a loading section in which respective print mediums are loaded.

9. The image processing apparatus according to claim 1, further comprising:

a leading-out section that respectively leads out a length from a folded position to a print region of the corresponding print medium on the basis of the quire page-count, the medium size information, the quire-book page-count and the respective quire-book page number as the binding margin value, wherein the determining section respectively determines the print region corresponding to the quire-book page number on the basis of the respective led out binding margin value; and the changing section performs a change operation to the change image data corresponding to the determined respective print regions.

10. The image processing apparatus according to claim 9, further comprising: a margin length storing section that previously stores a length of a margin region that is set on a side part of the respective print medium as a margin length, wherein the determining section further determines the print region on the basis of the margin length.

11. The image processing apparatus according to claim 9, further comprising: a first leading-out section that regards a length from the folded position to the binding position as the first binding margin value, and leads out the first binding margin values for each quire on the basis of the quire page-count, the medium size information and the respective quire page numbers; and a second leading-out section that regards a length from the binding position to the print region as the second binding margin value, and leads out the second binding margin values on the basis of the medium size information, the quire-book page count and the respective quire-book page numbers, wherein the leading-out section leads out a sum of the first binding margin value and the second binding margin value as the binding margin value corresponding to the quire-book page number.

12. The image processing apparatus according to claim 11, wherein the first leading-out section leads out the first binding margin values on the basis of the folded parts of corresponding quire.

13. The image processing apparatus according to claim 11, wherein the second leading-out section leads out the second binding margin values on the basis of the folded parts of a quire book.

14. The image processing apparatus according to claim 11, further comprising:

an image forming section that forms images onto the print mediums by using developer on the basis of the respective change image data that was changed.

15. The image processing apparatus according to claim 9, further comprising:

a first leading-out section that regards a length from the folded position to the binding position as the first binding margin value, and leads out the first binding margin values for each quire on the basis of the quire page-count, the medium size information and the respective quire page numbers;

an adding and generating section that respectively adds binding position image data representing the binding positions to the corresponding change image data on the basis of the respective led-out first binding margin values, and generates addition change image data;

a replacing and generating section that replaces a page order of the respective addition change image data so that the replaced page order corresponds with a page order of the quire book after bookbinding, and generates bookbinding print data; and an outputting section that outputs the generated bookbinding print data.

16. The image processing apparatus according to claim 15, further comprising:

an image forming section that forms images onto the print mediums by using developer on the basis of the respective change image data that was changed.

17. The image processing apparatus according to claim 1, wherein the changing section magnifies/reduces each page of the image data in order to accommodate it within the corresponding print region.

18. The image processing apparatus according to claim 17, further comprising: a magnification/reduction rate calculating section that calculates respective magnification/reduction rates on the basis of page sizes of the respective image data and region sizes of the corresponding print regions, wherein the changing section performs magnification/reduction of the corresponding image data on the basis of the respective calculated magnification/reduction rates.

19. The image processing apparatus according to claim 17, further comprising:

a magnification/reduction rate calculating section that calculates respective magnification/reduction rates on the basis of page sizes of the respective image data and region sizes of the corresponding print regions; and a selecting section that selects a smallest magnification/reduction rate among the respective calculated magnification/reduction rates, wherein the changing section performs a magnification/reduction of each page of the image data on the basis of the selected smallest magnification/reduction rate.

20. An image forming apparatus, having an image inputting section for inputting image data, saddle stitches respective quires that are made by folding print mediums and processes image data for binding a plurality of quires into a quire book, each quire having a plurality of pages, the image forming apparatus comprising:

a setting section that sets a quire page-count of each quire;

a size obtaining section that obtains medium size information of the print medium;

an assigning and obtaining section that assigns respective quire-book page number to each page of the inputted image data, and obtains an image page-count;

a page calculating section that calculates a quire-book page-count on the basis of the quire page-count and the image page-count;

a determining section that respectively determines a print region corresponding to the respective quire-book page number on the basis of the quire page-count, the medium size information and the quire-book page-count;

a changing section that respectively changes each page of the image data to change image data scaled to fit within the print region determined with respect to the corresponding quire-book page number; and an image forming section that forms images onto the print mediums by using developer on the basis of the respective change image data that was changed, wherein a first binding margin value is determined by the determining section based on a quire page number in a single quire, a second binding margin value is determined by the determining section based on the quire-book page number, and a binding margin value corresponding to each quire-book page number is calculated by the determining section based on the first and second binding margin values, and wherein the first and second binding margin values in odd-numbered pages and the first and second binding margin values in even-numbered pages are calculated by the determining section using different formulae respectively.

* * * * *